US005103730A

United States Patent [19]

Sarda

[11] Patent Number: 5,103,730

[45] Date of Patent: Apr. 14, 1992

[54] METHOD AND APPARATUS FOR CLEANING AND MAINTAINING PRINTING PRESSES

[76] Inventor: Jean L. Sarda, 48, Avenue Claude Vellefaux, Paris, France, 75010

[21] Appl. No.: 682,420

[22] Filed: Apr. 5, 1991

Related U.S. Application Data

[63] Continuation of Ser. No. 376,386, Jul. 6, 1989, abandoned.

[30] Foreign Application Priority Data

Jul. 7, 1988 [FR] France ..... 8809242
Jun. 14, 1989 [FR] France ..... 8907850

[51] Int. Cl.[5] ..... B41F 35/00

[52] U.S. Cl. ..... 101/425; 15/1.51; 15/256.51; 15/327.1; 15/363; 239/61; 239/67; 239/69; 239/708; 137/93

[58] Field of Search ..... 101/423-425; 15/1.51, 3, 256-257, 320, 327.1, 353-363; 239/23, 61, 67, 69, 97, 237, 238, 246, 290, 708; 137/93

[56] References Cited

U.S. PATENT DOCUMENTS

| | | | |
|---|---|---|---|
| 1,576,598 | 3/1926 | Goulding | 101/425 |
| 3,781,107 | 12/1973 | Ruhland | 15/7.51 |
| 4,007,983 | 2/1977 | Knieser | 15/256.51 |
| 4,192,231 | 3/1980 | Kawakami | 101/425 |
| 4,270,450 | 6/1981 | Difflipp et al. | 101/425 |
| 4,534,291 | 8/1985 | Sabota | 101/425 |
| 4,686,902 | 8/1987 | Allain | 101/425 |
| 4,722,273 | 2/1988 | Jahn | 101/425 |
| 4,774,884 | 10/1988 | Sugimoto et al. | 101/425 |
| 4,781,115 | 11/1988 | Veda et al. | 101/425 |
| 4,789,432 | 12/1988 | Goodnow et al. | 101/425 |
| 4,873,924 | 10/1989 | Nonomura et al. | 101/425 |
| 4,886,553 | 12/1989 | Gillich | 101/424 |

*Primary Examiner*—Eugene H. Eickholt
*Attorney, Agent, or Firm*—James E. Bradley

[57] ABSTRACT

An improved system for cleaning printing press components using a plurality of different cleaning fluids each specially adapted for cleaning particular printing press components including inking rollers, printing blankets and printing plates is disclosed. The plurality of fluids are selectively dispensed using a controller to automatically coordinate the dispensation of the selected cleaning fluids in a predetermined pattern to selected ones of the press components without delivery to nonselected others of the inking rollers, printing blankets and other printing plates.

55 Claims, 27 Drawing Sheets

METHOD AND APPARATUS FOR CLEANING AND MAINTAINING PRINTING PRESSES

This application is a continuation of application Ser. No. 376,386, filed July 6, 1989, now abandoned.

BACKGROUND OF THE INVENTION

1. Field of the Invention

The present invention relates generally to equipment for cleaning printing presses.

2. Description of the Prior Art

Over the last few decades, printing presses have been considerably improved, with many functions improved through automation. The peripheral equipment used in combination with printing presses have also evolved considerably. In contrast, a group of functions, though directly linked to the printing quality and process, but apparently of secondary importance, have been somewhat neglected by the manufacturers of printing presses.

In order to facilitate and understanding of the present invention, several functions necessary for the operation of an offset printing press (and particularly those linked to the invention) are described generally below. The offset printing mode has been selected to illustrate the invention, since it requires a certain number of supplementary functions compared to the other printing modes (such as, for example, typographic printing, flexographic printing, and others).

These functions can be defined generally as: (1) cleaning the inking units; (2) cleaning the printing blankets; (3) cleaning the printing plates; (4) cleaning the printing cylinders; and (5) cleaning the damping rollers.

The inking unit have to be cleaned at least once a day for presses using inks of the same color, and must be cleaned each time an ink of a different color is used. In the later case, the cleaning must be much more thorough to prevent traces of the ink from the preceding run from remaining on the surface of the inking and distributing rollers and altering the color of the subsequent ink. Changing inks can be especially problematic when a light colored ink follows a darker colored ink. In that case, it is important to clean the press several times over, re-inking it between each cleaning with white ink or the following ink, to absorb and eliminate traces of the previous ink.

The printing blankets also must be frequently cleaned. In addition, fibers and foreign particles stuck to the surface of the printing blankets must be removed. These fibers come from the sheets or paper web that is compressed between the blanket and pressure cylinders during the printing process. The number of cleaning operations needed depends upon several parameters such as, for example, the load and nature of the ink, the type of paper to be printed, the size of the run to be carried out. These cleaning operations can be performed, depending upon these parameters, on average about six to fifteen times a day, and sometimes much more.

The printing plates also require cleaning and frequent maintenance to keep good printing definition. After each prolonged stop the printing plates must be coated with an Arabic gum or similar product diluted in water to prevent their oxidization, which would very quickly render them useless. This operation consists of depositing a film of this dilution on all the plate areas which have been previously well cleaned, to isolate it from the oxygen in the air.

The printing cylinders also need to be cleaned since, during the printing or cleaning of the other elements, they are often dirty. This dirt will stain the back of the printed material without directly affecting the quality of the printing, unless there are large deposits of hardened ink on the printing cylinder.

The conventional damping device uses dampening rollers which are covered with flannel sleeves which require daily cleaning when one ink is used but also require cleaning when changes of ink occur, since particles of ink are emulsified by the dampening water rinse and catch on the surface of the sleeves. Cleaning is usually accomplished with a brush and detergent. This cleaning operation is tedious and involves decoupling of the damping rollers from the press.

After lengthy stops or changes to the printing speed, variations in the supply of dampening water cannot be avoided. Time is therefore spent making adjustments to obtain uniform damping and a stable balance between ink and water.

Sometimes, fibers from the covering of the dampform rollers are deposited on the blanket or on the plate. These cause the formation of spots or marks which affect the printing quality. In recent years, all sorts of dampening devices have been devised to avoid these limitations. These devices are all based on the concept of adding an alcohol low in toxicity, such as propanol, to the dampening waters to alter the surface tension of the dampening water to allow a sleeveless roller to transfer a thin uniform film of water.

Another, more recent improvement has been made by a water treatment and refrigeration unit which automatically takes into account and adjusts the alcohol and Ph content of the dampening water, the alcohol and Ph dosing the temperature of refrigeration, and filtration of the dampening water. In these water treatment and refrigeration units, treated water is circulated by means of a pump to establish a permanent circulation between the treatment and refrigeration unit and the press. Dampening water is returned from the dampening trays of the press to the unit where it is treated and homogenized before being reinjected into the circuit. This manner of preceding has major advantages including: (1) improved printing quality; (2) consistent printing quality without regard to room temperature; (3) a slower evaporation of the water on the plate; (4) improvement in the quality of water film requiring much less water (about 30% less) and thus enabling the shine of the inks to be improved and the risks of staining to be lessened.

It is probable that these treatment and refrigeration units will come into general use very quickly and replace conventional systems.

At present, the great majority of printing presses are equipped with devices enabling them to clean, imperfectly and in an amateurish fashion, all components of the inking unit including the inking distribution rollers and cylinders, with the exception of the ink fountain which is generally cleaned manually. This method of cleaning is old and in wide use.

Briefly, it consists of applying a rubber blade to the median line of one of the driven rollers of the inking unit after a solvent has been applied to the unit. This action has the effect of detaching the film of the ink from the roller. The removed ink is collected in a tray which is coupled to the blade. Each roller and cylinder is cleaned one after the other. The end result is a group of imperfectly cleaned rollers which accumulate ink in the tiny pores of their surfaces. Ink molecules will harden and eventually totally transform the state of the microporous surface into a shining slope unsuitable for retaining, distributing, and forming a required film of ink. The desired thickness of which is about ten to twenty microns and become unsuitable for distributing a fine and even layer of ink on the printing parts.

This method of cleaning with a blade presents a certain number of shortcomings and inadequacies, including: (1) While in use the blade becomes covered, on both sides, by a layer of ink diluted by the solvent. After scraping, the blade is removed from the cylinder. The layer of ink separates into two parts, one remains stuck to the cylinder and spreads itself immediately over all the rollers. (2) The blade, even when properly maintained and cleaned, becomes polluted with unwanted ink which then mixes with the succeeding washing inks. (3) The general condition of the blade has a direct influence on the final result. (4) The ink and its solvent form an agglomerate which dries and becomes firmly fixed on the tray and on both sides of the blade. The unit has to be scoured by hand periodically. Besides being tedious, the process is wasteful of the printer's time since tinting operations are suspended for cleaning. As a result, the printer puts off cleaning as long as possible.

Certain equipment for automatically or semi-automatically cleaning blanket cylinders has been available in recent years. These items of equipment involve different techniques which use a variety of mechanical means such as blades, brushes, and rollers in combination with detergents mixed in water to remove the surface ink and bits of paper fixed on the blanket. Such equipment has, until recent years, been in the form of attachments for presses. They are sometimes very sophisticated and controlled completely be electronic means enabling variable cleaning cycles to be programmed depending on a certain number of criteria. The most recent models pick-up the residual products by means of a spongy strip unrolled from one reel and automatically rewound during the absorption of the residual products. This procedure allows for a quick, clean and simple recovery of the residual products. The major press manufacturers are sporadically beginning to equip certain of their models with less sophisticated blanket washers. However, the cleaning and gumming of the plates is still carried out by hand on all offset presses.

It should be noted that all the functions cited above are an integral part of the printing process. Every professional printer realizes the vital importance of the surface conditions of his inking rollers and printing blankets. He or she knows that this surface condition is one of the essential elements to keep in order to retain rapid quality printing. Unfortunately, nowadays, the printer finds himself or herself confronted with contradictory demands. On one hand, intensive production is required. On the other hand, methodical maintenance of the printing press is required. Often, the printer finds himself or herself neglecting the daily maintenance of the printing press.

SUMMARY OF THE INVENTION

The present invention overcomes this shortcoming by providing the printer with a simple and rapid means which allow for daily maintenance of the printing press, inking rollers and printing blankets, without reducing productive time. The means proposed to carry out the invention also take into account the elimination of the cleaning and maintenance residues in an automatic or semi-automatic manner, depending on the importance of the equipment, but always without having recourse to cleaning by hand. Besides this, the choice of cleaning products proposed leans towards less toxic and more easily neutralized products, to diminish the risk of pollution of the environment during their use and disposal. The present invention is characterized by several advantages.

First, cleaning of the rollers and printing blankets enables their original service condition to be preserved as long as possible by fighting against the premature clogging of their microporous texture due to accumulation of the ink residues which stick, solidify, and transform the roller and blanket surfaces, making them unsuitable for normal use.

Second, maintenance of the rollers and printing blankets by simple actions which are not costly and are easily repeated, help avoid "glazing" and premature aging by keeping them supple and with a clean surface area enabling them to perform better.

Third, the printing plates are cleaned, gummed, ungummed, and automatically dampened with the present invention.

Fourth, the pressure cylinders are automatically cleaned.

Fifth, the ink fountain is automatically cleaned.

The invention is characterized by a coordinated execution of these different operations. The basic means and their control elements may be regrouped to form coherent wholes. One form of the invention includes a cooling and treatment unit for the dampening water. This coordination of equipment results in substantial savings in manufacturing.

The above as well as additional objects, features, and advantages of the invention will become apparent in the following detailed description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
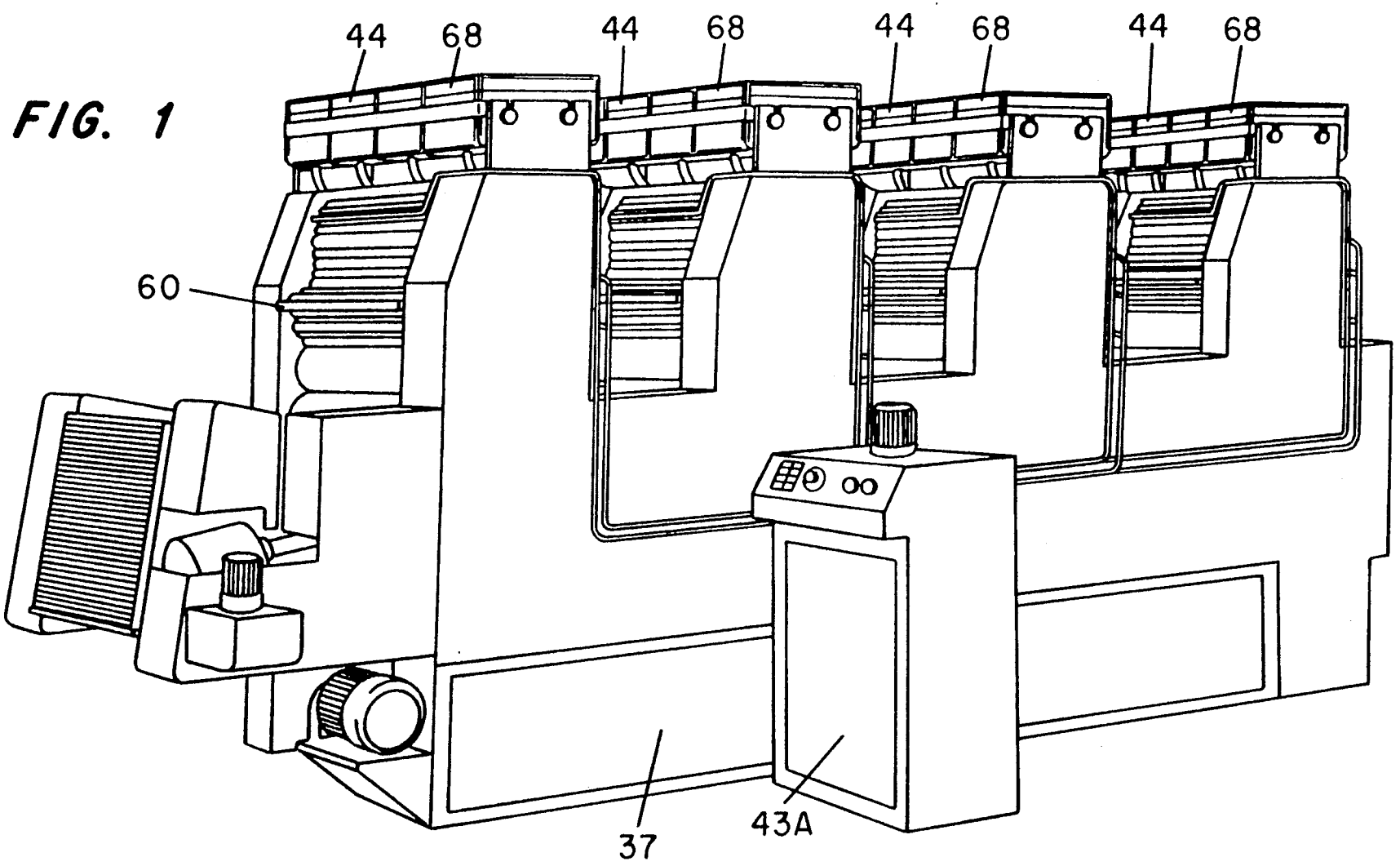
FIG. 1 is an offset four-color sheet press equipped with a cleaning, treatment and maintenance apparatus according to the invention.
Figure 2:
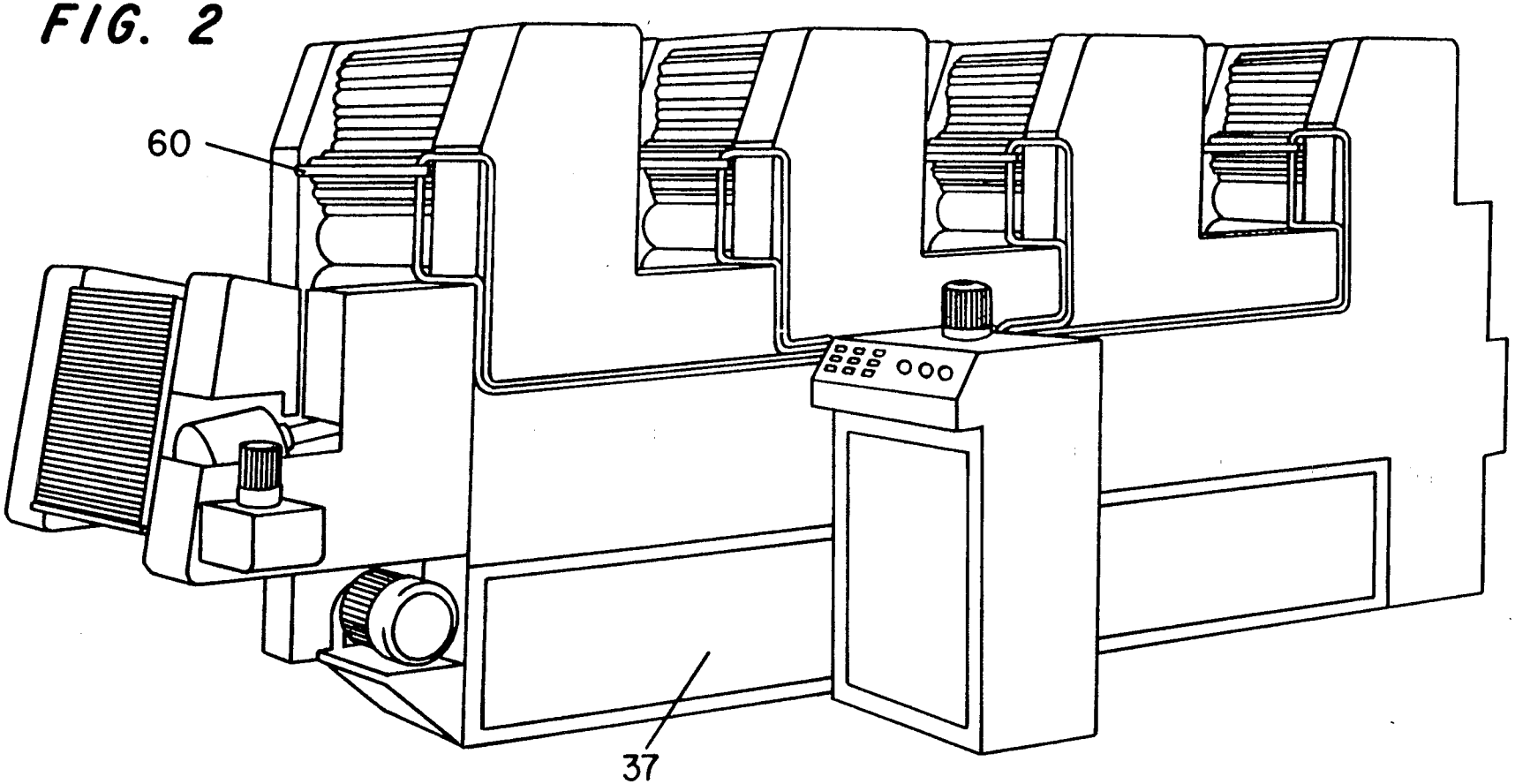
FIG. 2 is an offset four-color sheet press equipped with a coloring and treatment apparatus for the dampening waters.
Figure 3:
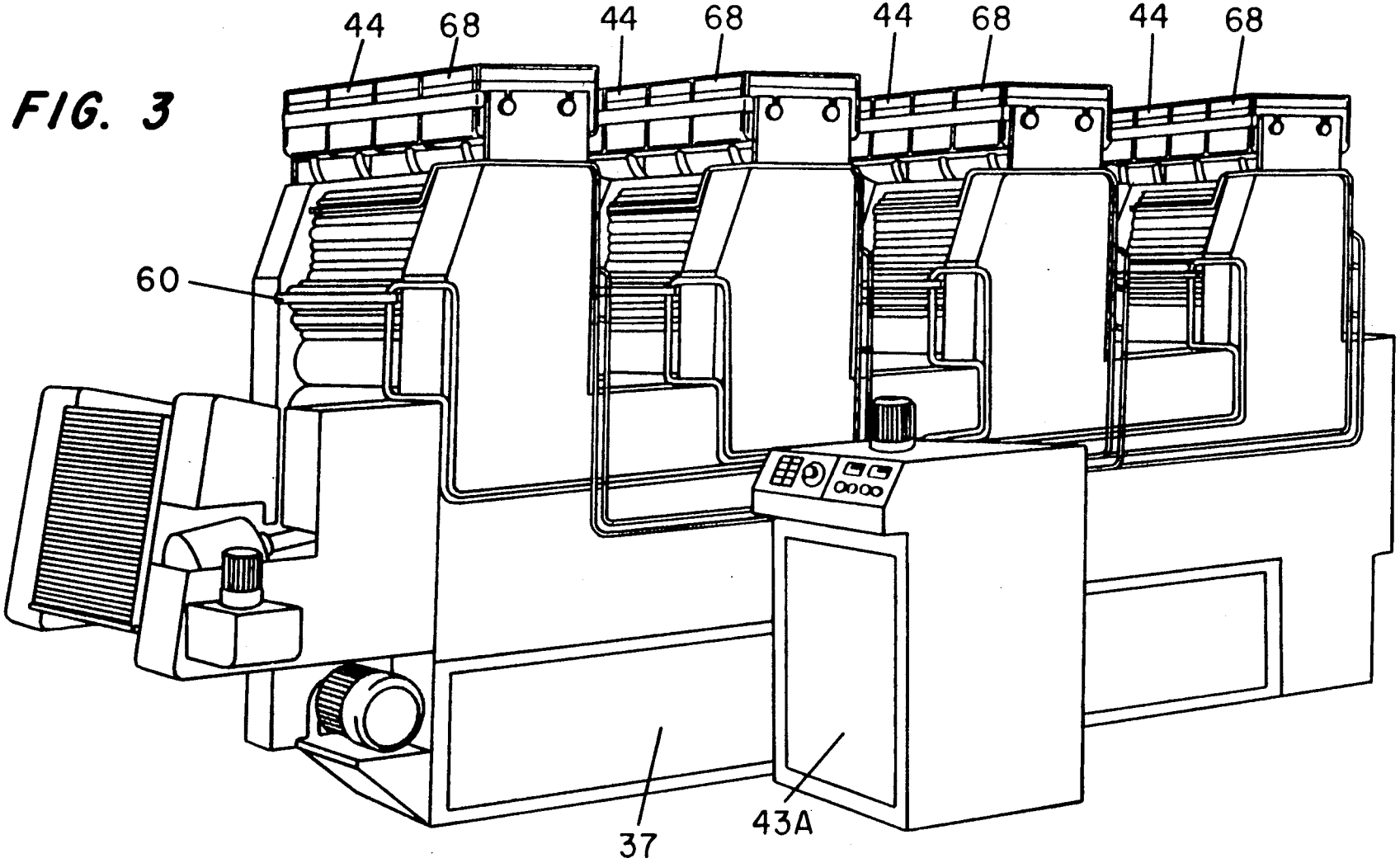
FIG. 3 is an offset four-color sheet press equipped with an apparatus grouping the cleaning, maintenance, cooling and treatment of the dampening waters from common elements working in combination.

Before describing the invention in detail, a certain amount of background information concerning the different elements will be provided, to give a better understanding of the objectives of the present invention.

This information particularly concerns the roll of inking and more particularly that of the rollers and printing blankets, as well as the washing solutions. In order to fully appreciate the present invention, it is useful to keep in mind the following propositions: (a) in offset printing, the thickness of the ink film representing the printing is about two microns; (b) this thickness must be perfectly even and consistent from one printing to the next; (c) this film must be spread evenly and without running of the ink onto the plate and from the plate onto the blanket, to obtain a very spare printing, keeping a perfect definition of all its fineness; (d) these demands must be accomplished varying from six to forty thousand copies an hours (that is about thirty to two hundred meters a minute) depending on the type of press.

It is easy to understand that a balance of these important objectives can only be obtained from printing elements which are perfectly matched and always maintained in good operating condition. Among the active elements which enable this performance to take place, the rollers and the printing blankets play an essential role. The inking is intended to bring to the printing plate a film of ink which is even, regular, homogeneous and always of the slightest possible thickness, depending upon the importance of the printing zones and the types of support to be printed.

Basically, these inking units are made up of rubber rollers which operate to transfer a rough film of ink from the inking fountain from roller to roller up to the damp-form rollers which apply the ink to the printing plate. Rotating crushing cylinders have an axial movement suitable for shearing and homogenizing the ink-film, and are inserted between all the rubber rollers. The transfer rollers (and particularly the damp-form rollers) play a major part, both in the formation of the ink-film and in the manner in which it is placed on the plate during the inking. The printing rollers intended for use with oily inks are usually made from synthetic rubbers of the nitril or EPT type. These rubbers have been chosen because they suffer relatively little damage from the oily inks and solvents used for the cleaning of these rollers. They also show an acceptable mechanical resistance, quite good aging, and a natural affinity with the oily inks, thus promoting the inking quality of the plate. These rubbers are the result of quite complex mixtures which are part of the know-how of each manufacturer and are made up of a group of adjuvants such as plasticizers and permanent anti-oxidizers intended to stabilize the mass.

Unfortunately, under continuous mechanical and chemical attack, these adjuvants have the tendency to disintegrate with use. At manufacture, the roller is submitted to an elaborate surface treatment which includes at least one grinding treatment and a finishing polish to calibrate the microporosity to be given to the surface of the roller. This microporosity is of prime importance not only in the formation of the film of ink, but in the quality and fineness of the inking.

Briefly, the formation of the film of ink by transfer from roller to roller is carried out in the following manner. The rotating rollers drive the ink. Pressure in the film increases until it balances that exerted by the rollers, and the rubber surface of the rollers move apart. At that point, the continuous ink-film comes between the rollers and the rollers separate slightly. In order to create a film of this nature, the ink must oppose a greater pressure than that exerted at the contact points of the rollers, and have a surface sufficiently rugged to favor the gripping of this film. The process of this balance is influenced, in part, by the rotation speed of the rollers, the mechanical play of the rollers, and the temperature of the ink (an increase in temperature results in a lower viscosity of the ink).

When the surface of the rollers have a good microporosity, the ink which comes into contact with this surface attaches easily. Consequently, the film is formed evenly even when very slight in thickness. In the opposite case, where the surface of the roller is smooth and hard in some areas but not in others, the ink holds badly, with a tendency to skate and obliges the printing press operator to increase the flow of ink in order to try and compensate for this fault. This response is prejudicial to the printing quality since it does not enable a good definition to be had. This result becomes even worse when the printer uses "short" inks (i.e. those with low viscosity).

Besides this, it must not be forgotten that when the damp-form rollers are in good condition, being well maintained and well adjusted, they exert a considerable pressure on the surface of the plate due to the microporous surface of the rollers and the plate, and the rheology of the ink used. In these conditions, the ink is finally spread on the plate without risk of skating and the contours of the image keep their precision. In the opposite case, the damp-form rollers "glazed" by the accumulation of dried ink on their surface (formed during repeated imperfect washing operations), and over inked, slide—leading to an over-inking of the fine points and an abnormal thickness of ink which then easily stains the sheets piled above. This fault worsens and becomes unbearable when light printed forms requiring a small amount of ink are treated.

The film of the ink transmitted from the blanket to the printed sheet is about two or three microns and represents about seventy-five to eighty-five of the total thickness of the ink film transferred from the plate to the blanket. The plate receives from the damp-form rollers a layer of ink twice the thickness of the layer of the ink put on the blanket. Damp-form rollers in good condition transfer about half their thickness during the inking of the plate. All this is to explain that the ink-film covering the damp-form rollers hardly goes over ten to fifteen microns and requires very great care in its creation, to ensure quality printing.

It must also be realized that a film of ink which is thicker than necessary causes a greater dampening of the plate which is prejudicial to the appearance of the printed material, causing it to become dull, washed out, with a loss of contrast. Quality of each detail contributes to the final result but the inking of the plate and the blanket is considered as representing one of the crucial elements, as far as quality and ease of printing are concerned. The blanket which has a very delicate surface also requires special care for it to be able to receive the impression from the plate and transfer it correctly onto paper. The blankets usually consist of layers of nitril rubber separated by a cushion of synthetic fibers which leave microscopic air cells which serve to absorb pressure and improve the transfer of the image received from the printing plate. These blankets are finely ground, calibrated, polished, and have a surface condition which is fine and velvety and favorable for receiving good impression and transfer of this impression onto the receiving support. Printings from the plate to the blanket can only be obtained by providing an acceptable pressure between them.

A glazed and badly maintained blanket requires additional pressure which shortens the blanket's life span and leads to a distortion of the image. To obtain a good print, one should always work with the minimum amount of ink, with the least possible pressure on the blanket. The effect of additional pressure between the normal pressure setting of one tenth and that of, for example, two tenths is about fifteen kilos per square centimeter. This difference represents a pressure which is excessive, leading to premature wear of the different mechanical elements of the printing press.

The printing plates also require careful treatment during the whole run. They must be kept clean at all times, and have to be free from impurities or clogging of the ink due to an incorrect adjustment of the dampening rollers or bits transferred from the blanket. The device of the present invention for dampening, cleaning, gumming, and ungumming the plate takes into account separately all these different functions. It also serves as an additional dampening device suitable for bringing immediate dampening to the plate during the different printing operations.

Before describing the apparatus, cleaning solutions, and use of the invention, it is important to keep in mind several facts. The cleaning of the inking rollers by transfer of the solubilized and diluted ink-film does not guarantee perfect cleaning. Perfect cleaning cannot be accomplished for several reasons. First, the rubber rollers produce static electricity which has a tendency to retract and retain on its surface the last molecular traces of the pigments. Second, the crushing tables now used are usually made of a plastic material based on the polyamide resin "rilsan," a product which is also not very favorable to the elimination of static electricity. Dampening agents which act as conductors help in reducing considerably the effect of this static and improve significantly the quality of the cleaning, but appreciably increase the price of the solutions because of the extra handling involved, and they do not prevent the other impediments to perfect cleaning due to other factors described below.

Third, mechanical factors also intervene to prevent perfect cleaning. A set of crushing tables, which have a rotative and translative movement, are inserted in the set of rollers in order to give good ink distribution. This axial movement has the tendency to push the ink back to the edge of the rollers and pollute them on the sides, with the residual material which is likely to move and come back up towards the surface during the following inking. Another source of problem is that the rubber rollers have a tendency to curve inwards and curl up at the ends, leading to a mediocre transfer of the solubilized or diluted ink-film in these areas. Another source of imperfect cleaning can be the result of the poor mechanical condition of the inking units of the presses to be equipped. All these reasons have lead to a cleaning and maintenance method which takes into account these parameters and which operates in several phases with the solutions described below. The blankets and impression plates have the advantage, of being cleaned by a combination of mechanical cleaning action with appropriate solvents.

The present invention is a combination of an apparatus for use with a number of specially adapted solutions. First, the solutions will be described, then the apparatus will be described. Described in detail below are the different maintenance products, cleaning solutions, and gums recommended to carry out the present invention, including solution A for cleaning rollers and printing blankets, solution B for daily maintenance, solution B1 for use when changing from dark to light colored inks, solution C for "deglazing" rollers and printing blankets, solution D for periodic maintenance of rubber surfaces, solution E for cleaning offset plates, solution F for gumming the offset plates, solution G for damping the plates, and alternate solution A which is more ecologically sound than solution A.

SOLUTION A

Solution A is for the basic cleaning of the rollers and printing blankets, and comprises and aliphatic diluent of the paraffin type with a low aromatic rate (2-5%) to which can be added two to five per one thousand of conductor agent.

A number of advantages are obtained by this solvent. First, solution A is paraffin based, and has a low aromatic rate which ensures a gentle and inoffensive action for the rubber of the rollers and printing blankets. Second, solution A has a strong "diluting" and "non-solvent" action, which, in contrast to solutions generally used, enables the cleaning of the "heavy" compounds in the ink such as pigments, and resins. Such heavy compounds are kept in suspension in the diluent and are separated by simple differences in density, allowing recycling of the diluent in which the oils and inks are incorporated. This lowers the cost of cleaning.

Solution A has a dynamic viscosity which is two or three times higher than that of the products generally used. As a result, solution A evaporates slower, causing a uniform spreading of the diluent in the ink-film to be evacuated and allowing for a longer action time. Also, as a result, solution A has an internal cohesion which improves the spreading properties, and produces a superior mechanical action favorable to the dilution and evacuation of the ink-film during its transfer from roller to roller. Also, as a result of the viscosity, solution A will penetrate deeper into the surface to be treated, avoiding dispersent in the depth the pigment molecules and residual siccatives which become fixed to the porosity of the rubber until a smooth and brittle film is formed. Solution A costs three or four times less than that of a classic washing solution, bringing an appreciable supplementary economy to which is added that of its reuse after decantation.

Solution A is practically an inodorous product, which pollutes very little and has relatively low flammability in comparison to the solvents (flash point 8° to 15°, diluents 80° to 100°). Solution A is an effective diluent which induces the flexibility of the oil inks, and is reenforced by the chemical affinity of the diluents contained in these inks which are the same as those used in the cleaning.

SOLUTION B

Solution B is for daily maintenance. It maintains the suppleness and the superficial physical properties of the rollers and printing blankets. It allows for non-siccativity of the residual ink molecules after washing, preventing them from sticking inside the microporosities of the rubber surfaces. Solution B does not dry on the rollers and can be made from a heavy plasticizer of the nitril rubbers or other, mixed with an anti-oxidant agent such as, for example, dibutyl paracresol or parametoxyphenol (for preventing the siccativity of the ink), an anti-ultraviolet agent of the benzotriazotes group, for example giving an efficient protection of about ninety percent against the action of ultraviolet rays and the degradation on the rubbers which results from the, and a product giving to the solution a string viscosity and internal cohesion destined to confer on it a mechanical and shearing action appropriate for extracting and transporting all the residual products in suspension in the micropores of the rubber surfaces. This product can be, for example, either a sandoly one thousand poise or an isophthalic alkyd resin of five hundred to three thousand poise or a polyisobutylene polymer with a high molecular weight. The anti-ultraviolet agents and anti-oxidants represent two to three percent of the formula and the total viscosity is adjusted depending on the type of unit used.

Solution B1 can be substituted for the B solution when changing from dark to light colored inks. This solution is the same as solution B to which is associated by three cylinder-crushing forty to fifty percent of an absorbing agent such as lime carbonate, or barium sulfate, which completes the cleaning action and carries away the last colored traces before the following inking.

SOLUTION C

Solution C is for "deglazing" action or solubilising of dried ink or semi-dried ink on the rollers or printing blankets. As an example, a good deglazing solution can be obtained with the following composition:

57% benzilic alcohol
29% white spirit at 90%
14% of butanol.

The use of this solution must be reserved for major emergencies since its repeated use shortens the lifetime of the rollers and blankets and progressively diminishes, by modifying their surface condition, the specific properties which have been given to them during their manufacture.

SOLUTION D

Solution D is for "periodic" maintenance of the rubber surface aimed at keeping, by a gentle mechanical action, the condition of the microporous surface of the rollers and printing blankets. This solution will, for example, be made up of:

15% aliphatic diluent
30% isophthalic alkyd resin or other
40% lime carbonate (depolishing and absorbing agent)
15% monomer plasticizer.

This viscosity will be adjusted by modifying the proportions of the other constituents, depending on the type of agent used, to create a strong mechanical action (such as, for example, isophthalic alkyd resin). In all instances, keep at least thirty percent of the lime carbonate or similar substances.

SOLUTION E

Solution E is for cleaning offset plates. As an example, a solution giving good results and of which one of the principle constituents, Arabic gum, has tendency to be replaced by C.M.C. (carboxy methyl cellulose) for which the price and ease of supply are incomparable:

Arabic gum 400 grams
water one liter
sodium benzoate 2 grams (bactericide agent).

This concentrated solution corresponds to about fourteen Baume degrees and is brought into use at about ten degrees.

SOLUTION G

Solution G is for dampening the plates. It includes:

Phosphoric acid at 19.2° Baume, 30 cubic centimeters
Solution of Arabic gum at 14° Baume, 500 cubic centimeters
Mother solution of ammonium bichromate, 100 cubic centimeters
Distilled water, 400 cubic centimeters.

Mix forty cubic centimeters of this solution with five liters of water. The mother solution of ammonium bichromate is prepared as follows:

ammonium bichromate 200 grams
water 800 grams.

The fact that the invention takes into account, from common means, all the following functions: The cleaning fluids of the present invention clean without attacking the rubber surface to maintain the rollers and the printing blankets in preparation for the following printing; The cleaning fluids of the present invention clean, gum, degum, and dampen the offset presses.

ALTERNATIVE SOLUTION

Laboratory tests have proven that cleaning solutions which are more biological and even less likely to pollute than those proposed will be possible in the near future. For example, as a replacement for solution A, a water solution is proposed giving encouraging results, made up of:

3 to 6% of methylecellulose carboy (a thickening and floculant agent enabling the dilution to be decanted)
1 to 2% of magnesium nitrate (an agent for passivation protecting the metallic parts)
Phosphoric acid for solution at about 5 of Ph
0.2% sodium benzoate (bactericide agent)
4% of isopropropilic alcohol (facilitating the dilution)
1 to 3% of a tensioactive agent having a double function chains, hydrophile at one end and lipophile at the other end, the oily bodies attach themselves to the lipophile bodies 3% of caustic soda to accelerate the dilution
15% of biodegradable washing powder
water to complete the percentage.

From the solutions based on this principle, all or part of the other solutions and products useful for the carrying out the invention can be built up by adding adjuvants in solution or in suspension in the solution.

From each of the proposed cleaning solutions and maintenance products, a method of carrying out the different stages of the invention is described overall below based upon the criteria that the molecular traces of residual ink must not dry.

CLEANING OF THE PRINTING ROLLERS ON A PRESS USING THE SAME COLOR SUCCESSIVELY

A pump brings the solution A to a desired location in the printing press. The rollers are supplied with solution A in small quantities. The rollers operate conjointly with the cleaning device to permit a good impregnation of the ink-film and its loss, by stages, of viscosity in such a way as to favor its evacuation obtained by transfer from roller to roller. The polluted diluent returns by gravity or by pumping to the stock tank where it decants either naturally, or by centrifugal action. The residues of ink, resin and pigments are evacuated periodically into a plastic throwaway envelope. After use, the diluent may be slightly colored and it may be necessary to have, in the case of a color change from dark to light or after a certain number of cleanings, an additional reserve of pure Al solution to distribute during the last wash to ensure a better completion of the cleaning.

DAILY MAINTENANCE TO BE CARRIED OUT AT THE END OF THE DAY

After washing the inking group and blanket, bring the B solution to cover all the rollers, agitate the rollers to impregnate them to put ink microparticles which could have escaped the main cleaning operation in suspension in the solution, do not allow drying. This prevents them from fixing of ink in the pores of the rubber and forming (after a certain number of cleaning operations) the glazing prejudicial to a good inking and to reliability of the rubber surfaces.

Besides this, these surfaces keep their flexibility and their original condition longer thanks to the combined action of the plasticizers, anti-ultraviolet and anti-oxidant agents. Before re-inking the press, allow for a sequence of quick washing with the A solution.

CLEANING OF THE PRINTING ROLLERS INTENDED FOR TREATING AFTERWARDS AN INK OF A MUCH LIGHTER COLOR THAN THAT USED PREVIOUSLY

The same course of action as above is followed, replacing the B solution by B1 so as to absorb the last traces of ink before re-inking.

ABNORMAL WASHING DUE FOR EXAMPLE TO AN INK HAVING DRIED ON THE ROLLERS OR HAVING PARTIALLY DRIED

From the distributor placed above the press, bring the deglazing solution C, and let the press turn a moment until the solution has had its effect and begun to attack the film of hardened ink. Then, supply solution A. Let it all dilute for several seconds and collect it in the tank H. If necessary, repeat the procedure.

Carry out this procedure in the same manner in the case of rollers or blankets not having undergone acceptable maintenance, their pores being partially blocked. Finish the operation with the help of solutions A, B or B1 depending on whether the press is to be re-used immediately or not.

PERIODIC MAINTENANCE AT LEAST MONTHLY

Let the press turn for at least a quarter of an hour with the D solution. The gentle and polishing action gives back and maintains the fine "velvety" porosity necessary for good inking and transfer from the printing rollers and blankets. After this mechanical action, complete a normal wash with solutions A and B. Send back the used solutions into the decantation or waste tank.

CLEANING OF THE BLANKETS

The procedure for cleaning the blankets is more or less the same as that for the inking rollers; however, this operation is carried out more often during a printing run. In this case, an A or Al solution may be used as long as it is remembered that the more volatile the solution is, the more it becomes impregnated and attacks the rubber shortening the life span of the blankets.

Depending on the types of paper to be printed, the blankets collect fibrous bits of paper and require an added amount of water during their cleaning. It is sufficient in this case to supply the device by pumping a small quantity of water or dampening solution G before diluent and, if necessary, repeat this operation.

DAMPENING, CLEANING, GUMMING OF THE OFFSET PLATES

Water or dampening water solution G is brought by pumping to the dampening, cleaning, gumming, and degumming device of the plate. After a rapid dampening action for a few seconds, the excess water is sent back by pumping or gravity to the reserve. The cleaning solution E is then pumped up to the same device where the cleaning takes place by mechanical action combined with that of the solvent. The excess is sent back into the tank which receives the non-recyclable residual products. The gumming solution F is pumped and brought in its turn to the same device. After use, the excess solution is sent back to the reservoir. The degumming is achieved before printing with the help of the dampening solution G or pure water. The operations for cleaning the ink fountain will be explained later, in detail, and with reference to the attached drawings.

As an example, all the constituents of an oily printing ink used for the inking of the rollers, blankets or printing plates to be cleaned are described below and represent a typical formula.

Basic varnish:
32% phenolic resin, formo phenolic or maleic
20% linseed oil or a mixture or good wood oil
10 to 20% alkyd resin
25 to 30% aromatic diluent.

Offset ink:
65 to 70% basic varnish
20 to 25% organic pigments
3 to 4% aliphatic diluent for adjustment of the viscosity and rheology
4 to 5% adjuvant such as wax, siccatif, anti-scratching agent, etc. . .

THE APPARATUS

The cleaning device of the present invention has the advantage of being very compact and useful for carrying out three principle functions. It is driven by a two-part gear linked to a turning axis of the press, and operates without regard to the direction of rotation of the gear. The rubber components of the apparatus have a porosity and surface condition which permits use of the device in different modes.

In the blanket cleaning function, the rubber components will be made of polyurethane of about sixty shores, used for its strong mechanical resistance. Its grinding will be quite rough, adding to the action of the diluents in water, a mechanical action which is gentle but efficient and of a similar nature to that produced by a gentle brush.

For the cleaning by transfer of the rollers, a rubber of the same sort or nitril, but with a finer surface grinding is used. The type of rubber could be an elastomer of honeycomb polyurethane or a thick nitril of about thirty to forty shores, which is very supple.

This very simple device can be activated in its different functions either manually or with the help of electromechanical means linked to an electronic control unit. It includes a steel shaft which has edges which serve to scrape the cleaning solution from the roller surfaces. This shaft, after use, rotates and soaks in the diluent and cleans itself before the next cleaning cycle. Water replaces the diluent when it is for treating the plate to be gummed.

An example of the working of the cleaning device is shown in FIGS. 5 through 9.

Figure 7:
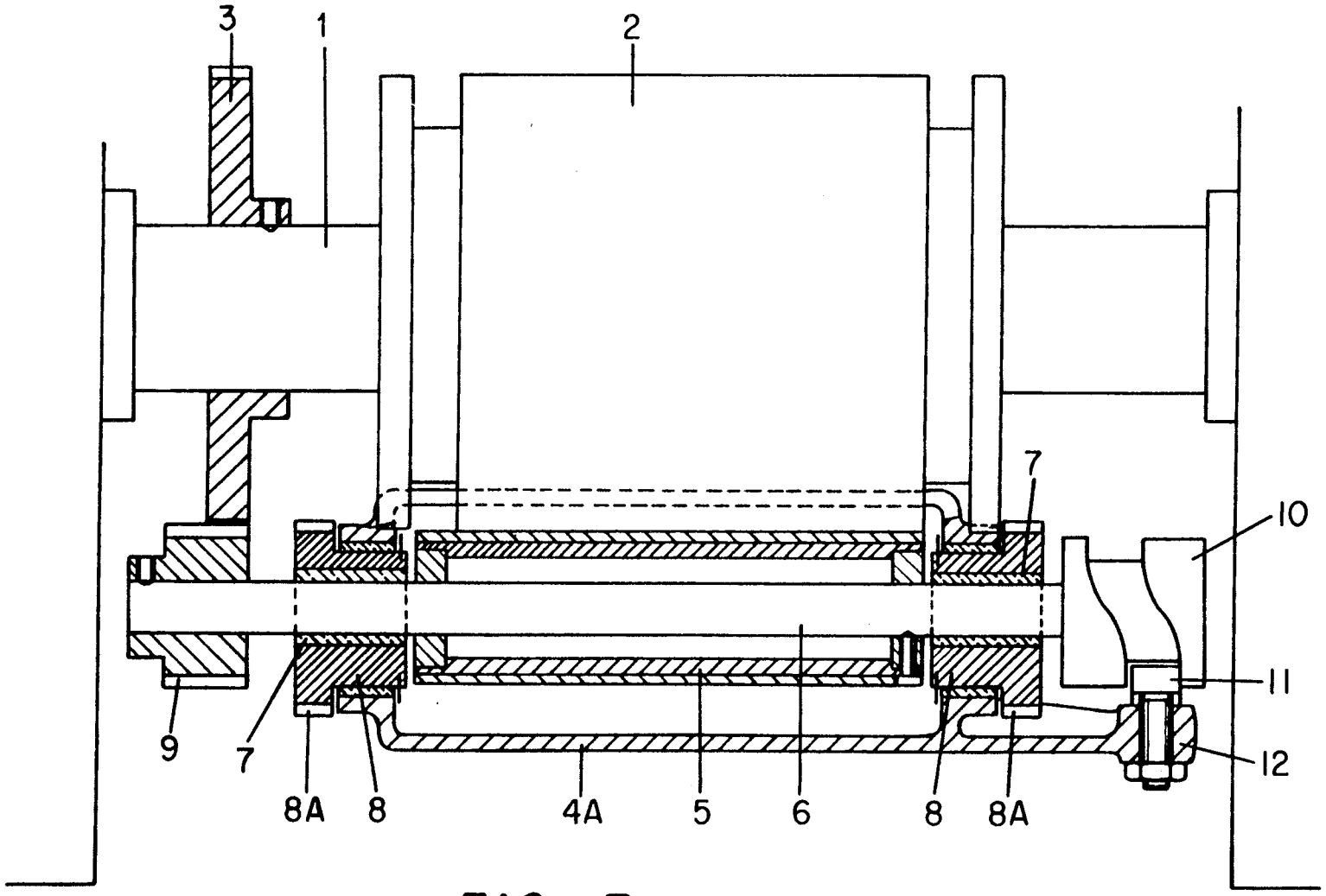
FIGS. 7, 8, 9, 10, 11 are cleaning, gumming and dampening devices shown to carry out the invention.

The shaft 1 of FIG. 7 of the blanket-bearing cylinder 2 is equipped with a two-part gear 3. Rubber cylinder 5 rotates in tray 4A which turns about within rings 7 which are tightly fitted in the off-center rotative bearings 8, each having a gear 8A for start up. Gear 9 is coupled to one end of axis 6 and is driven by gear 3 of the cylinder-bearing blanket 2. Spiral cam 10 is coupled at the other end of axis 6, having a spiral groove therein. Cam roller 11 is fixed on boss 12 of tray 4A and is disposed in the groove of spiral cam 10. Gears 3 and 9 are rotated by the action of off-center bearings 8 which actuates rotation of the recovery cylinder 5 as soon as the printing press is set in motion. The rotating movement also imparts side to side movement of cylinder 5 thanks to the action of cam 10 on cam roller 11.

Figure 8:
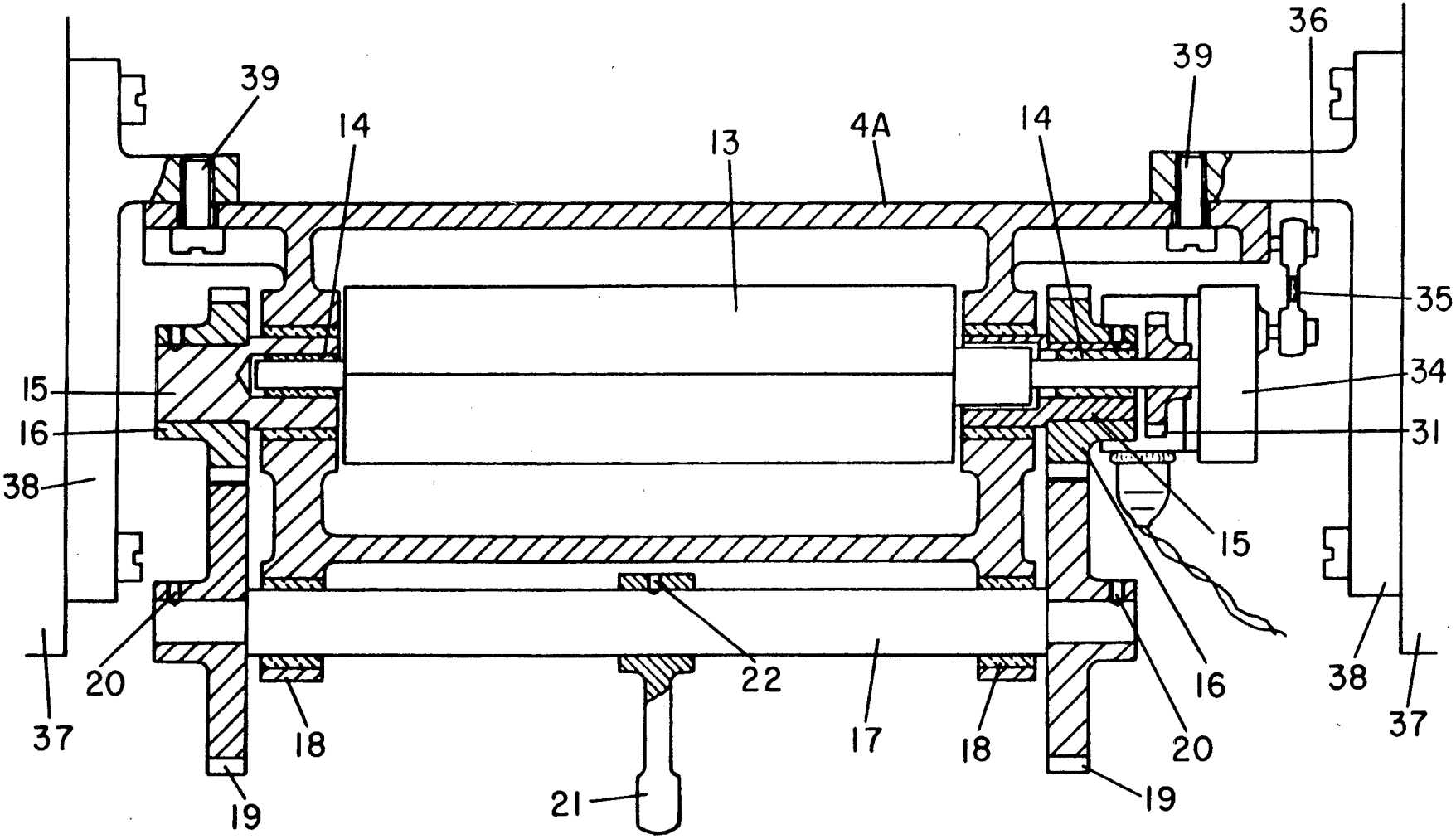

As shown in FIG. 8, steel blade shaft 13 is placed under recovery cylinder 5 and turns in rings 14 which are tightly mounted to the off-center rotating bearings 15 and driven by gear 16. Shaft 17 oscillates in bearings 18, and carries each end of gear 19, which is held in place by fixed screw 20. Lever 21 is blocked on shaft 17 by the fixing screw 22 and is linked to the axis 13 of FIG. 9 to the mobile armature 24 of the electro-magnet 25 articulated on tray 4A by axis 26 fixed on boss 27. Lever 21 has an adjustment screw 28 to limit the travel in the "rest" position. This screw leans on boss 29 under the action of return spring 30. One of the ends of blade shaft 13 of FIG. 8 has a four-tooth ratchet wheel 31 in which the holding ratchet 32 of FIG. 10 fits, and is held in position by return spring 33. This same end of blade shaft 13 of FIG. 8 is fitted and blocked in the torque limiter reducer of the moto-reducer 34, mounted floating at the end of the shaft and held in rotation by the anti-torque link 35 fixed to the frame of tray 4A by axis 36. The hole of the device is fixed to frame 37 of printing press by means of supports 38 on which tray 4A is fixed and held in place by fixing screws 39.

To initiate the cleaning of the blanket, the printing press is set in motion. A dose of washing solution A is dispensed on recovery cylinder 5 of FIG. 9 by watering banks 40 and 41 via valve 52A of FIG. 12. Voltage is applied to the electro-magnet 25 of FIG. 9, causing the rotation of shaft 17 of FIG. 9 by action of mobile armature 24. Gears 19 of FIG. 8 sets the off-center bearings 15 in rotation via gear 16 which themselves drive off-center bearings 8 of FIG. 7 via gears 8A. The off-center movement of bearings 8 of FIG. 7 puts the recovery cylinder under pressure against the blanket of the blanket-bearing cylinder 2. The recover cylinder 5 deposits the cleaning solution on the blanket. This spiral movement causes a stirring and mixing of the layer of ink deposited on the blanket. The layer of ink on the blanket is diluted by the cleaning solution and is recovered by recovery cylinder 5. The off-center movement of bearings 15 of FIG. 8 bring together blade shaft 13 and recover cylinder 5 of FIG. 9.

Figure 9:
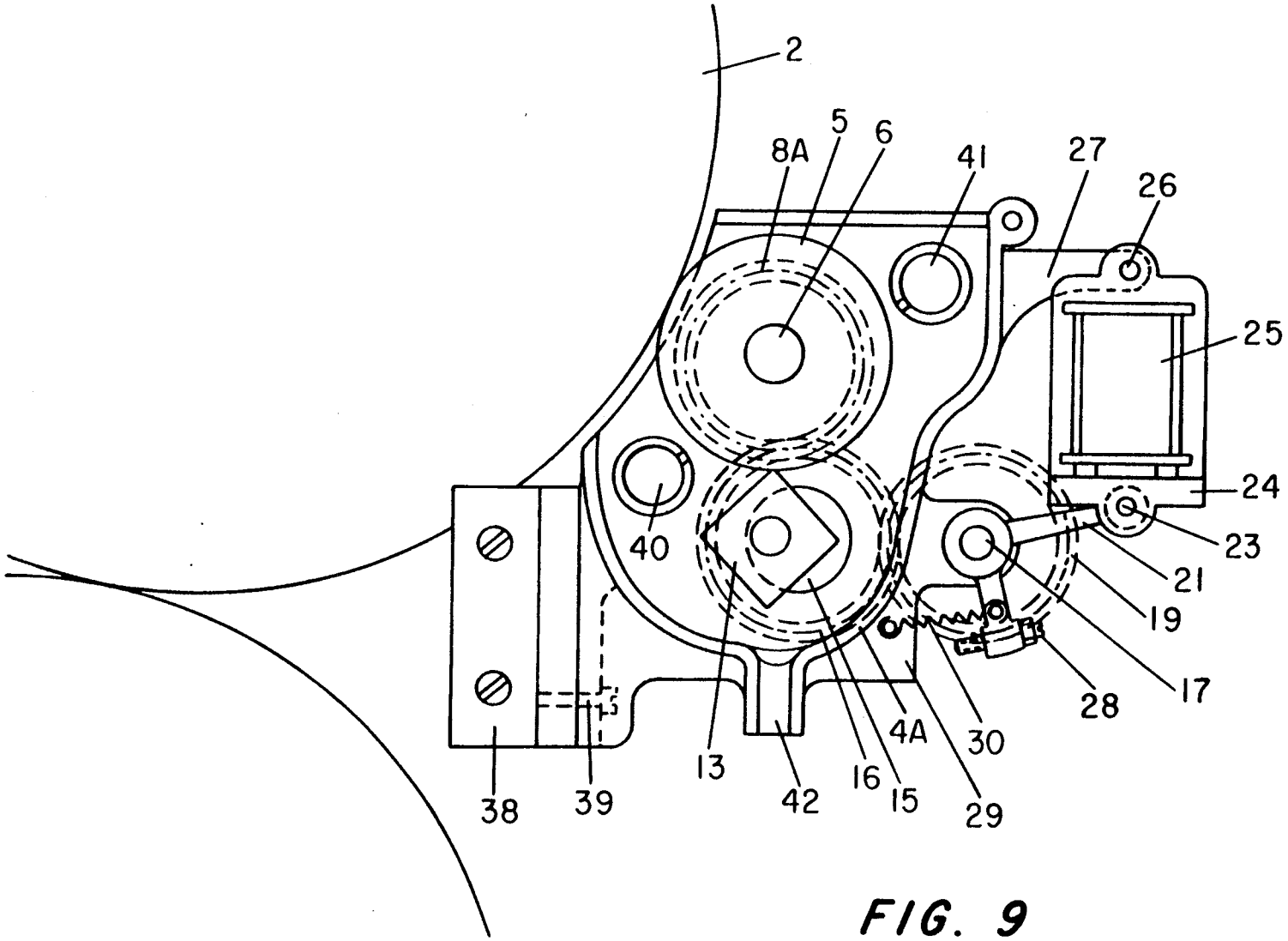
Figure 10:
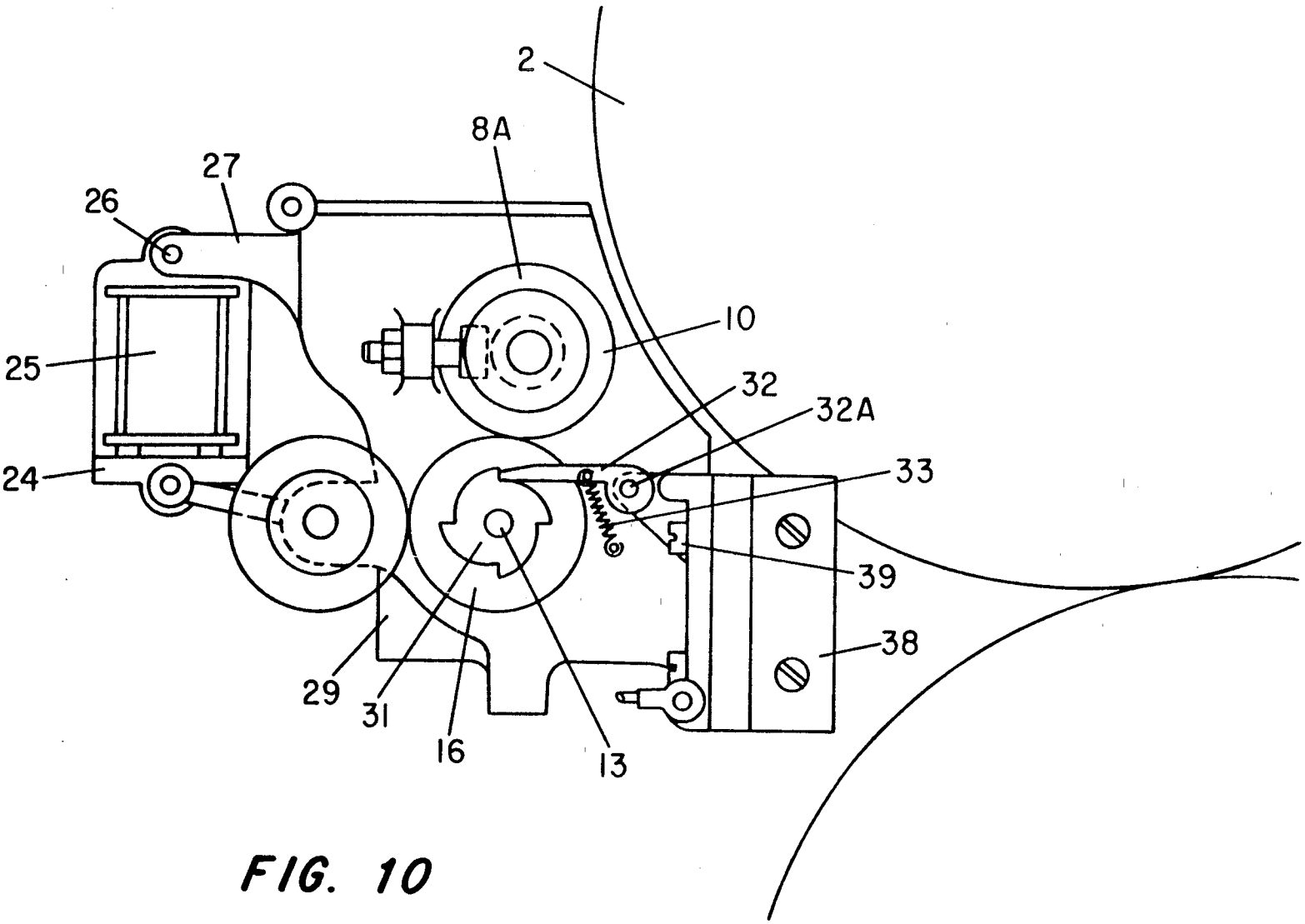

The moto-reducer 4 of FIG. 8 is set in motion in the blocking direction of ratchet wheel 31 of FIG. 10 to lock the ratchet in a position with the edges of the shaft blade 13 of FIG. 9 against recovery cylinder 5, thus progressively clearing the diluted ink from the blanket. The torque limiter of moto-reducer 34 of FIG. 8 protects the reducer from the sudden stop of ratchet wheel 31. The power to the motor is switched off. If the washing of the blanket has not been sufficient on the first cleaning operation, an additional action can be carried out by watering the recovery cylinder 5 of FIG. 9 again with type Al solution or with a mixture of solution type Al and water via the watering bank 40. The product recovered by the scraping of recovery cylinder 5 runs to the bottom of tray 4A which empties into the decantation tank or into the residual products tank via the draining opening 42. If the blanket has been correctly washed, the power to electro-magnet is switched off. The recovery cylinder 5 moves away from the cleaned blanket, and blade shaft 13 comes away from recovery cylinder 5. The moto-reducer 34 of FIG. 8 is set in motion in the free rotation direction, thus causing the blade shaft 13 to turn.

The type A solution is projected by watering banks 40 and 41 of FIG. 9 cleaning the recovery cylinder 5, the blade shaft 13, and tray 4A of any trace of polluted product. The solution is emptied through the draining opening 42 into the recovery tank, where the cleaning solution is decanted and recycled. The stopping of the moto-reducer 34 of FIG. 8 will cause the device to come to rest. By moving the position of the ratchet by rotation of off-center axis 32A of FIG. 10, a quantity of solution is deposited as a film on the recovery roller 5 of FIG. 9, and a change in thickness is obtained.

Figure 11:
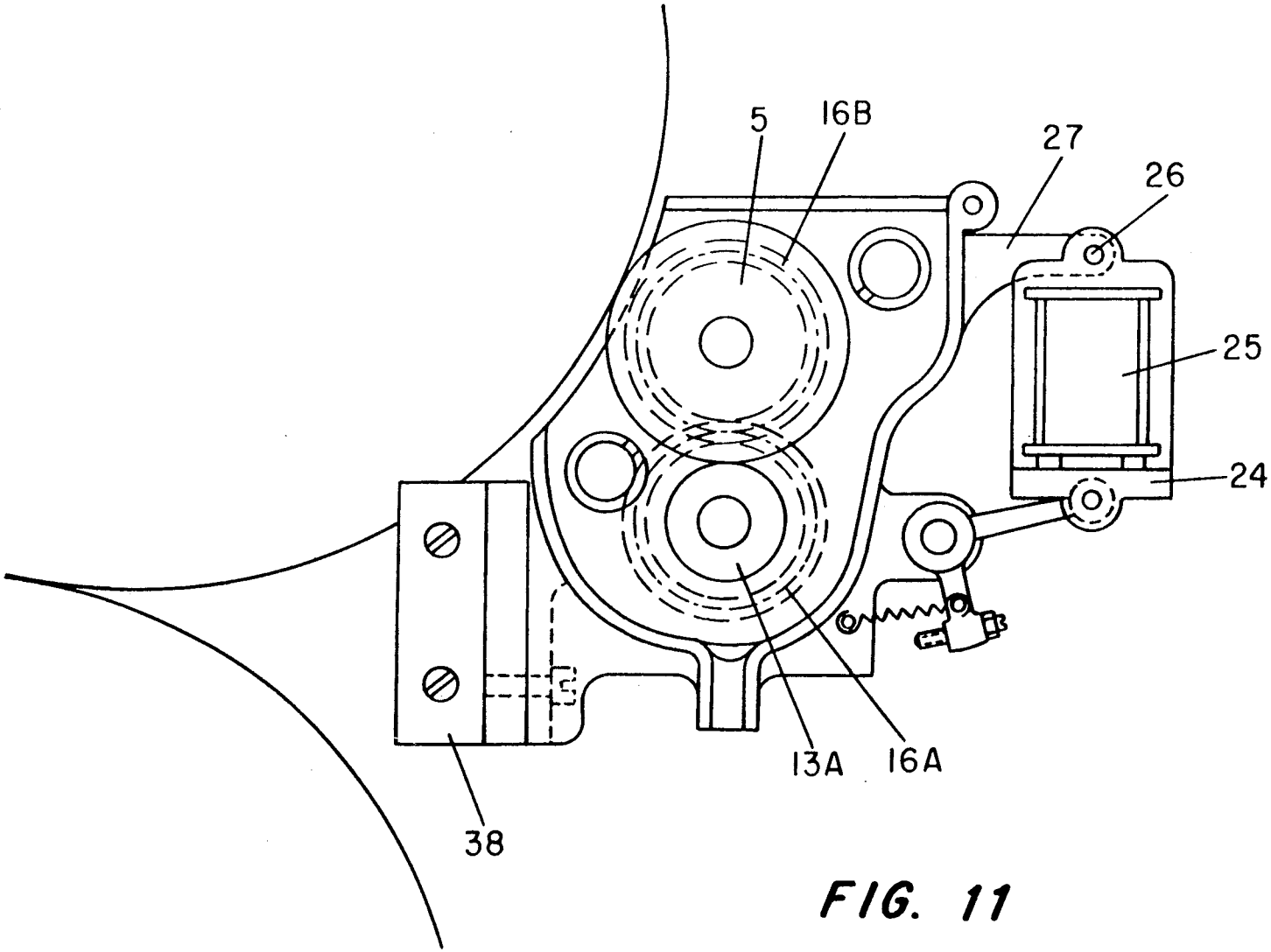

FIG. 11 represents a schematic view of a washing device 4 with blade shaft 3 of FIG. 9 replaced by a metallic roller 13A which is driven by gears 16A and 16B (which have the same number of teeth). The difference in diameter of the recovery roller 5 and wiping rollers 13A results in different circumferential speeds, causing a wiping motion.

It is obvious that all sorts of devices giving the same service can be used in substitution for those shown, without moving beyond the spirit of the present invention. The device shown can also be advantageously mounted as a substitute for the traditional rubber blade of small presses.

Figures 12A, 12B, 12C:
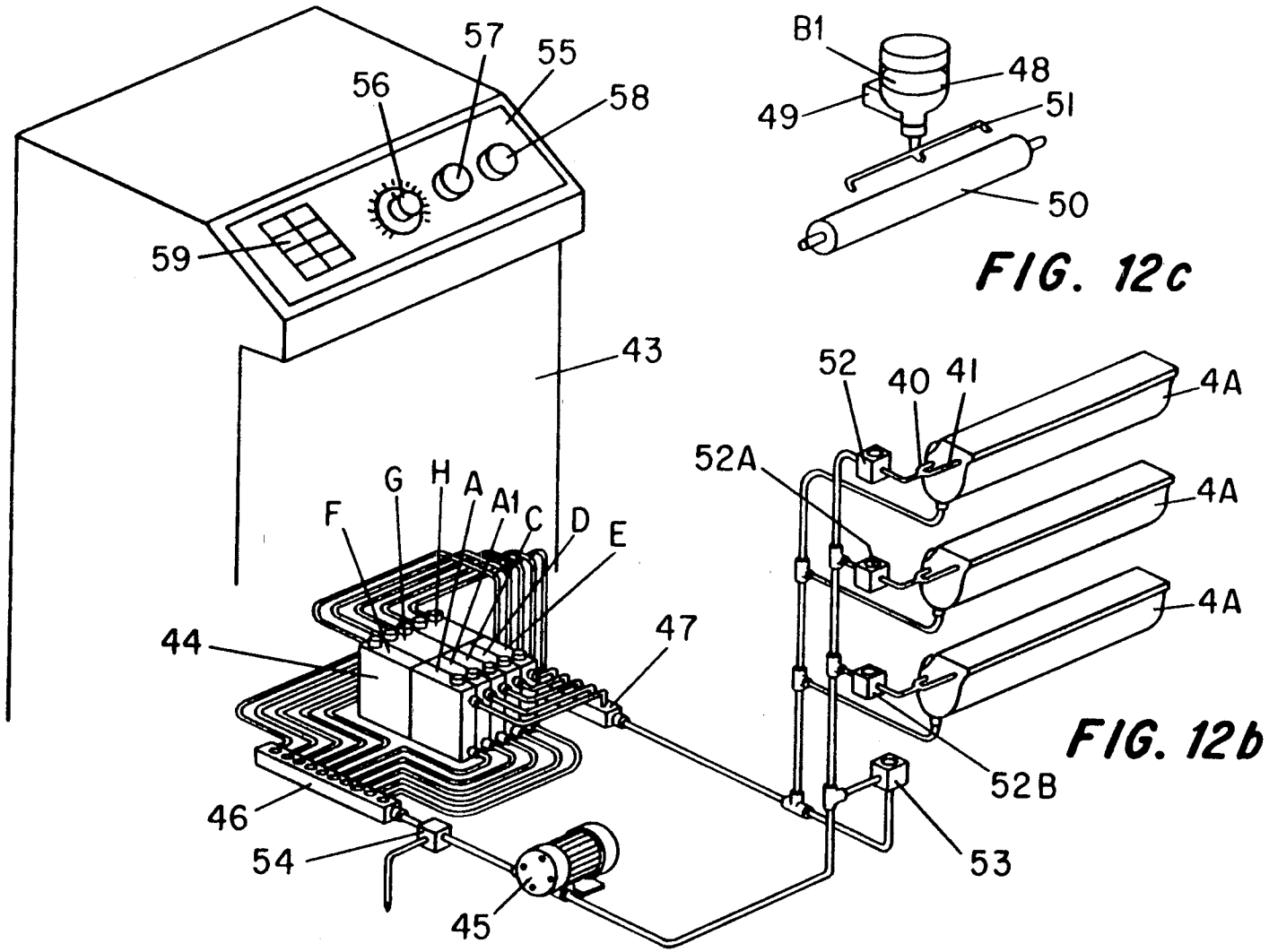
FIGS. 12*a*, 12*b* and 12*c* are views of various components of a cleaning and treatment apparatus.

An example of a cleaning and treatment system for presses is shown in FIGS. 1 and 12. Cabinet 43 of FIG. 1 contains the reservoirs 44 of FIG. 12 of the solvents used. The motor-pump unit 45 pushes the selected solvent into the watering banks 40 and 41 of the trays 4A of the washing devices. The distributor block 46 directs the suction of pump 45 towards reservoir 44 of the selected cleaning solvent. Distributor block 47 enables the return of the excess solvent which has not been used, from trays 4A to the reserve, or to be evacuated towards the residual solvent tank H if the solvent is no longer recycleable.

Double piston grease pump 49 directs solvent B1 to the inking distributor 50 since the high viscosity of the solvent B1 makes it difficult to pump it with pump 45.

Electro-valve 55 enables each washing tray to be supplied with a solution suitable for the cleaning cycle used. The gumming product must not be distributed on the rollers and blankets, whereas the rollers and blanket solvents must not be distributed on the plate. Electro-valve 53 is actuated between washing cycles to enable a rinsing flush (made up of dampening waters) to be circulated by the pump towards the residual solvent tank H. In this way, the pollution of one solvent by another is avoided. A complete draining of the pumping circuit can be obtained by means of draining valve 54 which returns the residual water of the flushed rinsing water contained in the hoses.

Depending on the type of washing required, the sequence programmed by electronic gear box 55 will differ. The cleaning of the blanket or the plate can be occasionally required during a run. In contrast, a complete wash will become necessary when changing a color. The following example explains and describes the complete cleaning treatment sequence of the press.

The programs selector 56 of the electronic gear box 55 is positioned for a complete wash. With the printing press 37 of FIG. 4 in motion, the program is started by pressing start button 57 of FIG. 12. The motor-pump 45 starts up. At the same time, distributor block 46 selects the solvents and the programmed electro-valve opens and distributes solution A. In addition, electro-valve of distributor 47 opens allowing the return of solution A to its reserve H. Dampening water is added to solution A from reserve G and is distributed in the same manner by opening, then closing, the corresponding valves of the distributor units 46 and 47 to ease the removal of the fiberous bits fixed to the blanket. The electro-valves 52 and 52B are open so as to permit the corresponding washing devices to bring the solvent into the inking unit and onto the blanket. Voltage is applied to electromagnets 25 of FIG. 9 and the washing devices of FIGS. 12 and 13 start to act as previously explained. After the lapse of a preprogrammed time interval, the electro-valves to solution A in the distribution blocks 46 and 47 close as well as the valves 52 and 52B. The electro-valve of distributor block 46, which controls the dampening water, opens along with electro-valve 53, short-circuiting the washing devices.

The electro-valve controlling the return of the residual solvents tank is also open thus permitting pump 45 to send a flush of cleaning water through the pipes. After this, all the electro-valves close, leaving open those controlling the reserve of solvent E of the distributor group 46 and 47 as well as the electro-valve 52A which gives access to the plate washing device. The water from the previous flushing will form, with solution E, an emulsion suitable for an effective cleaning of the plate.

Another selected program could open electro-valve 54 after stopping the pump motor 45 to allow water contained in the pipes to be drained directly to the drain. After washing with solvent E, all the electro-valves close, and those controlling the dampening water and valve 52A of the plate washing device open ensuring perfect rinsing of the plate by water. Similarly, after closing of the electro-valves which control the dampening water, those controlling the reservoir of the gumming solution are open to ensure protection of the good condition of the plate. After the return of the overflow of the solvent to its reserve, a flushing with water is necessary. Water is routed directly to the drains through electro-valve 54.

For lengthy pauses in the printing process, maintenance solution B is distributed in the same way by the opening and then closing of the corresponding valves of the distributor units 46 and 47. When changing from a dark color to a light one, solution B1 (stocked in the container 48) is distributed onto the distributor roller 50 via pump 51 and means of the electro-pump 51 by means of the electro-pump 45 is stopped and electro-valves are all closed again and the washing unit is stopped.

The foregoing is just an example of one mode, since the selection of another program defines another operating mode. Contacts 59 of console 55 give direct access to control of electro-pump 45 and each electro-valve, allowing intervention, without going through a complete washing cycle.

Figures 13A, 13B, 13C:
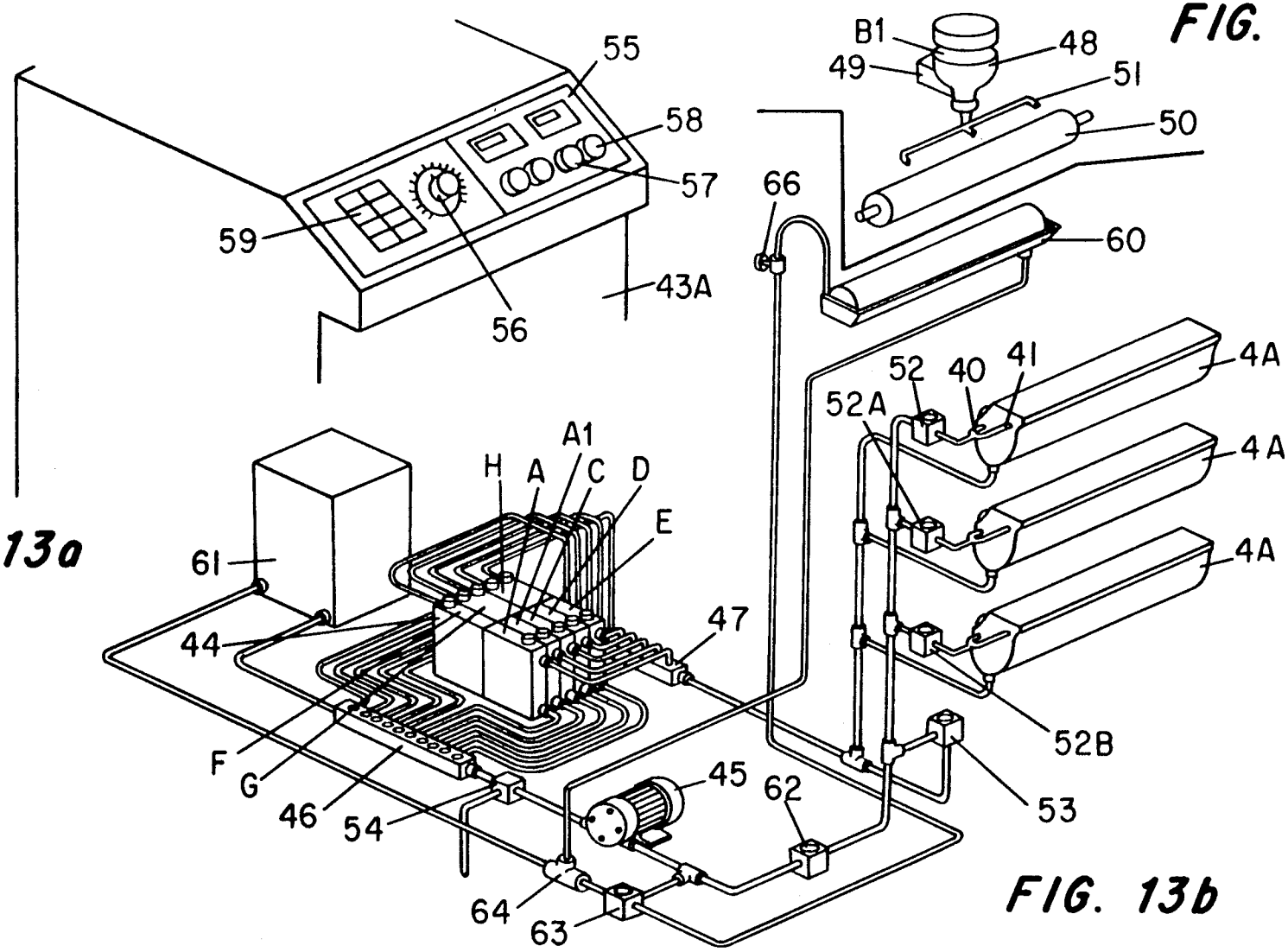
FIGS. 13*a*, 13*b* and 13*c* are views of various components of cleaning and treatment apparatus comprising as well a cooling and water treatment module.

FIG. 13 shows a cleaning and maintenance unit which includes dampening water treatment module 61. In this form of the invention, reservoir 44 of the dampening water G is replaced by the dampening water treatment module 61 which enables the constant recycling of the dampening water 60. Other elements, (not shown but well known) ensure the cooling, filtering, checking of Ph, and recycling of the alcohol. Only the pump motor 45 and the water reserve are shown in detail as they work in combination with the elements of the cleaning and maintenance unit. After closing of isolation electro-valve 63 and opening of the isolation electro-valve 62, the unit functions in the same was as explained in the previous example. Switch 58 is an emergency stop.

When operating in the dampening water treatment mode, mainly during printing, pump motor 45 runs continuously. The isolation electro-valve 62 is closed, in this way cutting the washing devices out of the circuit. Isolating electro-valve 63 is opened, thus permitting a free circulation of the water of the treatment module 61 towards this same treatment module in a closed circuit, through injector 64 with a "venturi" effect. Part of this water is drawn off and directed towards dampening tank 60 through the flow regulator tap 65 and level regulator valve 66. The suction due to the "venturi" effect in the injector continually empties the dampening tank 60. Water is thus continually renewed and treated in module 61. As shown in FIGS. 1, 3, 4, and 6, some of the reservoirs 44 containing different solutions can be stacked on top of the press 37 and filled with the help of pump 45, thereby reducing the floor space required for the apparatus of the present invention.

In another form of the invention, the air vacuum pump operating to supply the press with sheets is used in combination with other equipment to replace the liquid pump described in the other forms of the invention. This economical way of proceeding enables the presses to be equipped in an automatic, semi-automatic or manual way depending on the printer's wish. As in the other forms of the invention, the pump is used for two purposes; it carries the different solutions to the requisite places to supply the different devices, and also serves to fill the distributors.

Figure 4:
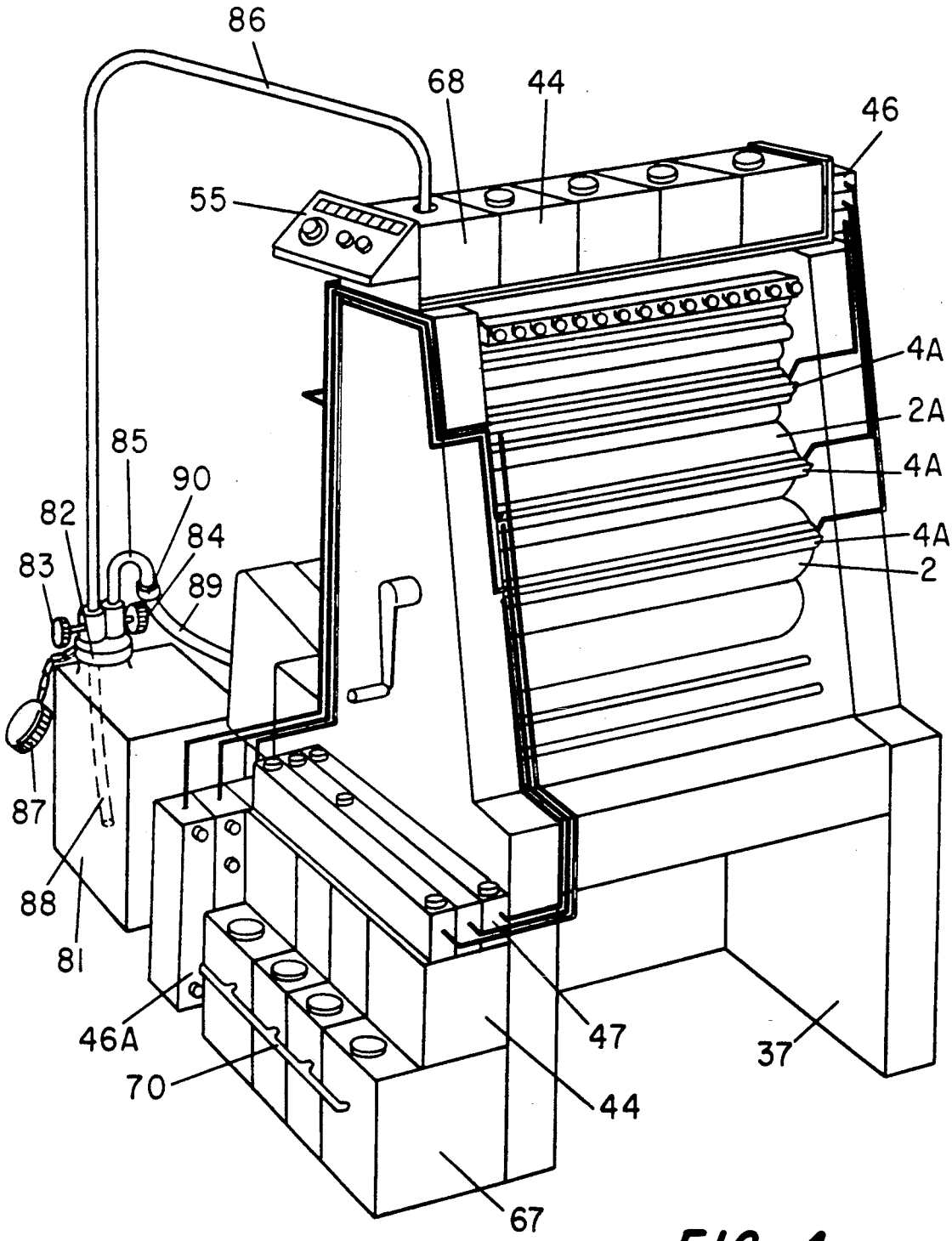
FIGS. 4 and 5 are offset one-color sheet presses equipped with a cleaning and maintenance apparatus working in combination from the air pump of the press.
Figure 5:
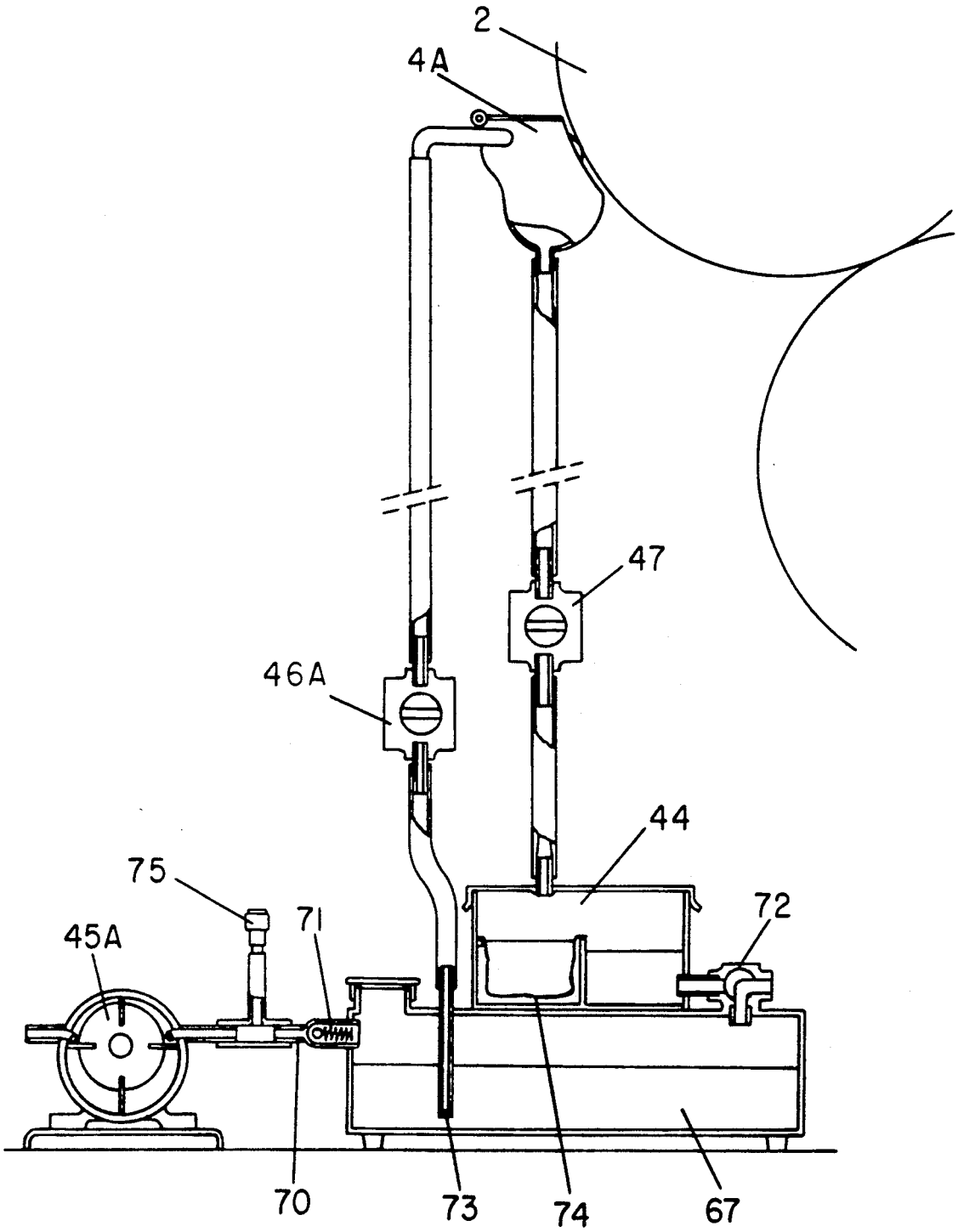
Figure 6:
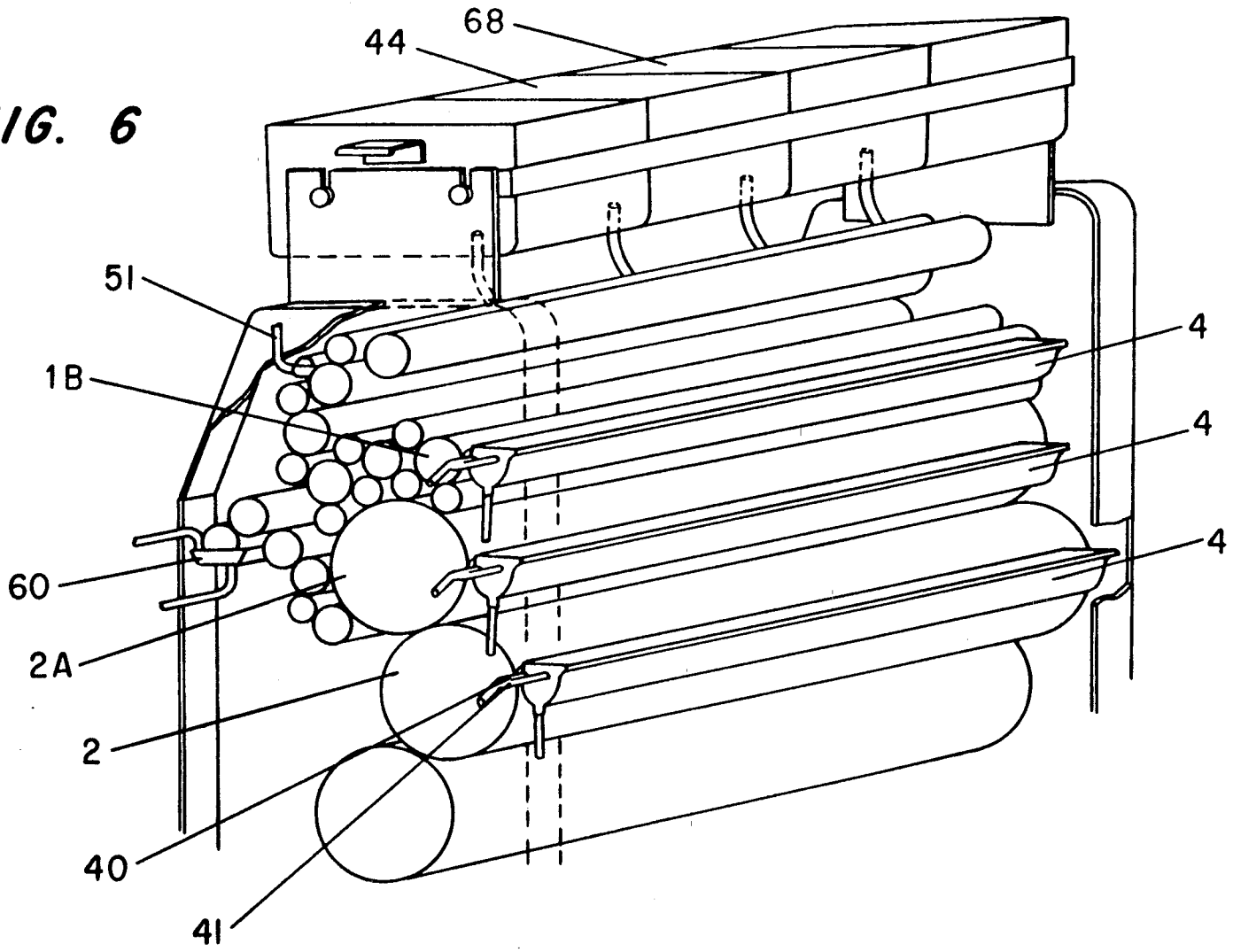
FIG. 6 is a printing unit equipped schematically with cleaning and treatment means.

FIGS. 4 and 5 show a printing press 37 equipped with a set of containers and distribution valves with pumping means which use the air pump normally necessary for the manipulation of the paper through the press.

The containers 68 of FIG. 4, situated on the top of the press, supply the washing devices with solutions and maintenance products, through the distribution block 46 (electro-valves not shown for the clearness of the diagram). Containers 67, situated on the ground, supply the washing devices through distribution block 46A. The distribution block 47 divides the used products into the recovery and decantation tanks 44 before their recycling into the reserve containers 67. These watertight containers are put under slight pressure by the air-pump of the printing press via the distributor tube 70.

FIG. 5 explains the functioning of one of these containers. The distribution electro-valve 72 allows three connections: (1) atmospheric pressurizing of the reservoir 67; (2) draining of the decanter; and (3) a closed position with electro-valve 72 closed, air pump 45B of the printing press puts the container 67 under slight pressure through the filling tube 70 and the retaining valve pressure limiter 71. On opening the distributor electro-valve 46A, the diving tube 73 draws in the reserve the product which is pushed towards the washing device by the air pressure. On opening the distributor electro-valve 47, the overflow of the product pushed into the washing device runs into the decantation tank 44 where it is temporarily collected by the throwaway recovery bag 74 where the products of the decantation form a sediment. When the reserve of the container 67 runs out, detected by level detector (now shown for the simplicity of the drawing), the distributor electro-valve 72 pus the container 67 at atmospheric pressure, then authorizes the draining of the decantation tank 44 from which the decanted product returns to the initial reservoir. The closing of the distribution valve 72 puts the whole of the device back to the cleaning function. The relatively low consumption of the cleaning solution enables the recycling periods to be spaced out.

The connecting of the different tanks and distributors is done with flexible hoses and quick connections in such a way as to make it easy to dismount for a periodic maintenance of the tanks. The operating of the elector-valves is ensured by the electronic box 55 of FIG. 4 which allows a washing program to be chosen depending on requirements or immediate manual intervention.

The means used for the operating of the electronic box 55 use a conventional principle and are not, for this reason, shown. The filling of the containers 68 can be carried out easily by means from the pressure obtained by the air pump 45A of the printing press 37. The cubitainer 81 containing the solution of the product having to fill a container 68 is a packing coming directly from the product conditioning factory and serves as principal reserve. The normal closing plug 87 is replaced by the plug 82 of which the plunging tube 88 serves to draw up the product. The tube 85 is connected to the air pump 45A of FIG. 5 of the printing press by the flexible hose 89 by means of a rapid connection 75 and 90 of FIG. 4. The tap 83 authorizes the product to rise in the flexible hose 86 up to the container 68. The tap 84, which is open, puts the interior volume of the cubitainer 81 at atmospheric pressure. The taps 83 and 84 being closed, the printing press is set in motion. The air pump 45A of FIG. 5 propels air into the cubitainer 81 of FIG. 4 and puts it under slight pressure. The opening of the tap 83 causes, in the hose 86, the rising of the product which is poured into the container 68 selected. The filling of the latter completed, the closing of the tap 83 stops the filling up; the opening of the tap 84 causes the pressure in the cubitainer 81 to fall which allows the plug 82, which could be used on another cubitainer to raise another product, to be undone.

Figure 14B:
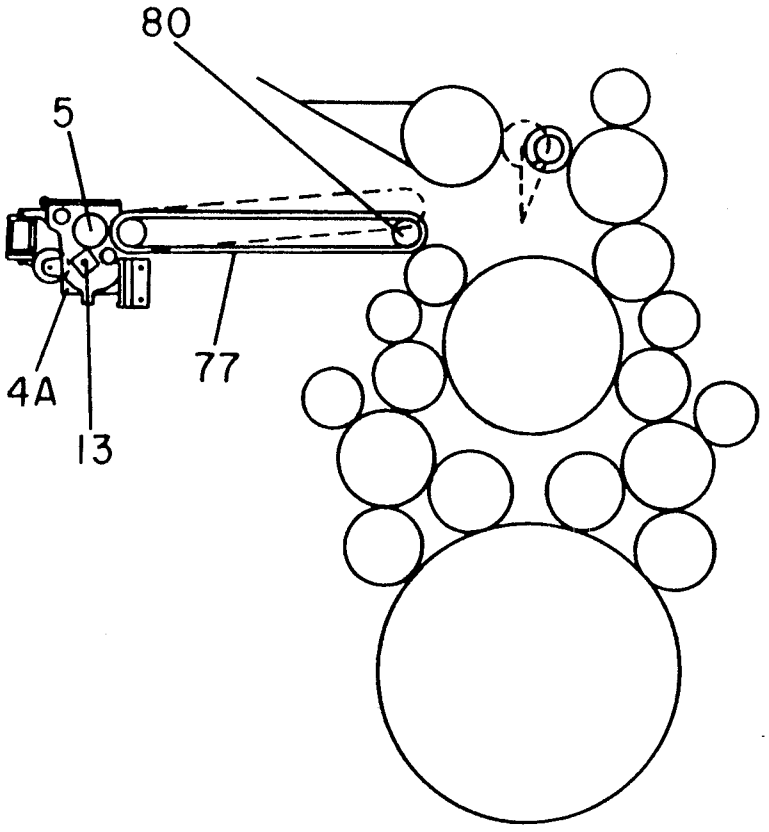
FIGS. 14A and 14B is a device for cleaning by transfer of ink from a transporting strip.
Figure 14A:
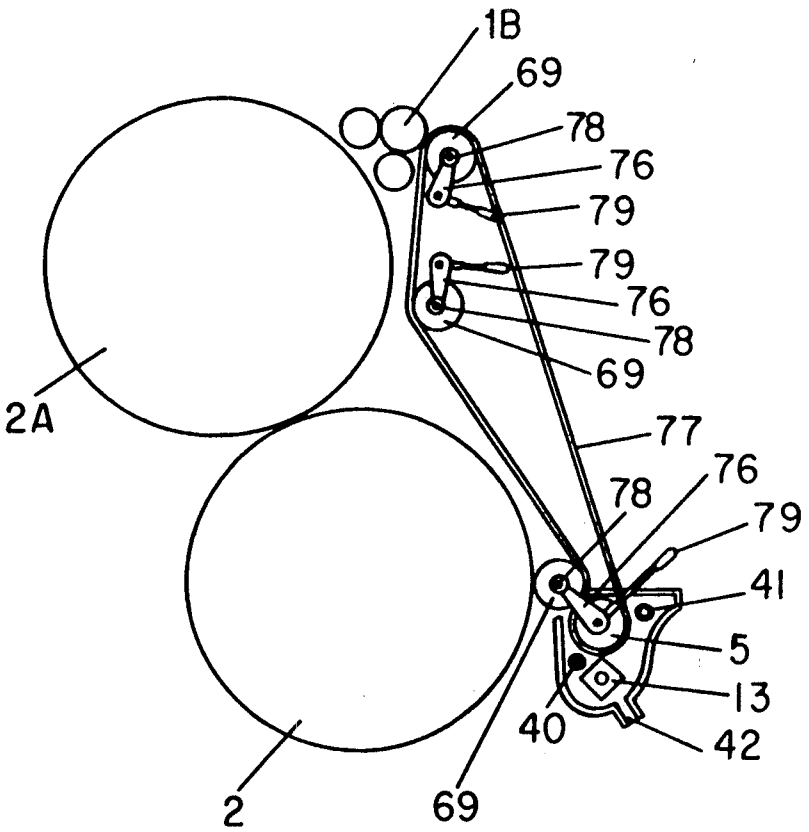

An example of a simplified washing device with a recuperation strip is shown schematically in FIG. 14A. Roller 5 rotates in the tray 4A of the washing device with recuperating strip 77 is wound about it. The pressure cylinder 69 rotated on the axis 78 puts the recovery strip 77 under pressure against the distributor cylinder 1B, blanket-bearing cylinder 2, and the plate-bearing cylinder 2A. Movement of levers 79 transfers the washing solution onto the desired cylinder. The blade shaft 13 recovers solvent after dilution of the ink as it is evacuated by the drainage opening 42 towards a residual solvent or decantation tank for recycling.

FIG. 14B shows a washing device mainly used in the case where direct access to a crushing cylinder of the inking group is not possible (or only with difficulty). The transfer strip 77 is driven by the pressure roller 80 rotated in the bearings of a chassis (not sown for the clearness of the drawing). During the washing operation, the transfer strip is pressed against the cleaning cylinder, thus enabling the washing solution and the diluted ink to be carried towards the recovery cylinder 5 cleared of the used products by the drive shaft 13. As in the previous examples, the used solvents and the overflow are evacuated via the opening 42 towards a residual products tank or a decantation tank for recycling.

Figure 15:
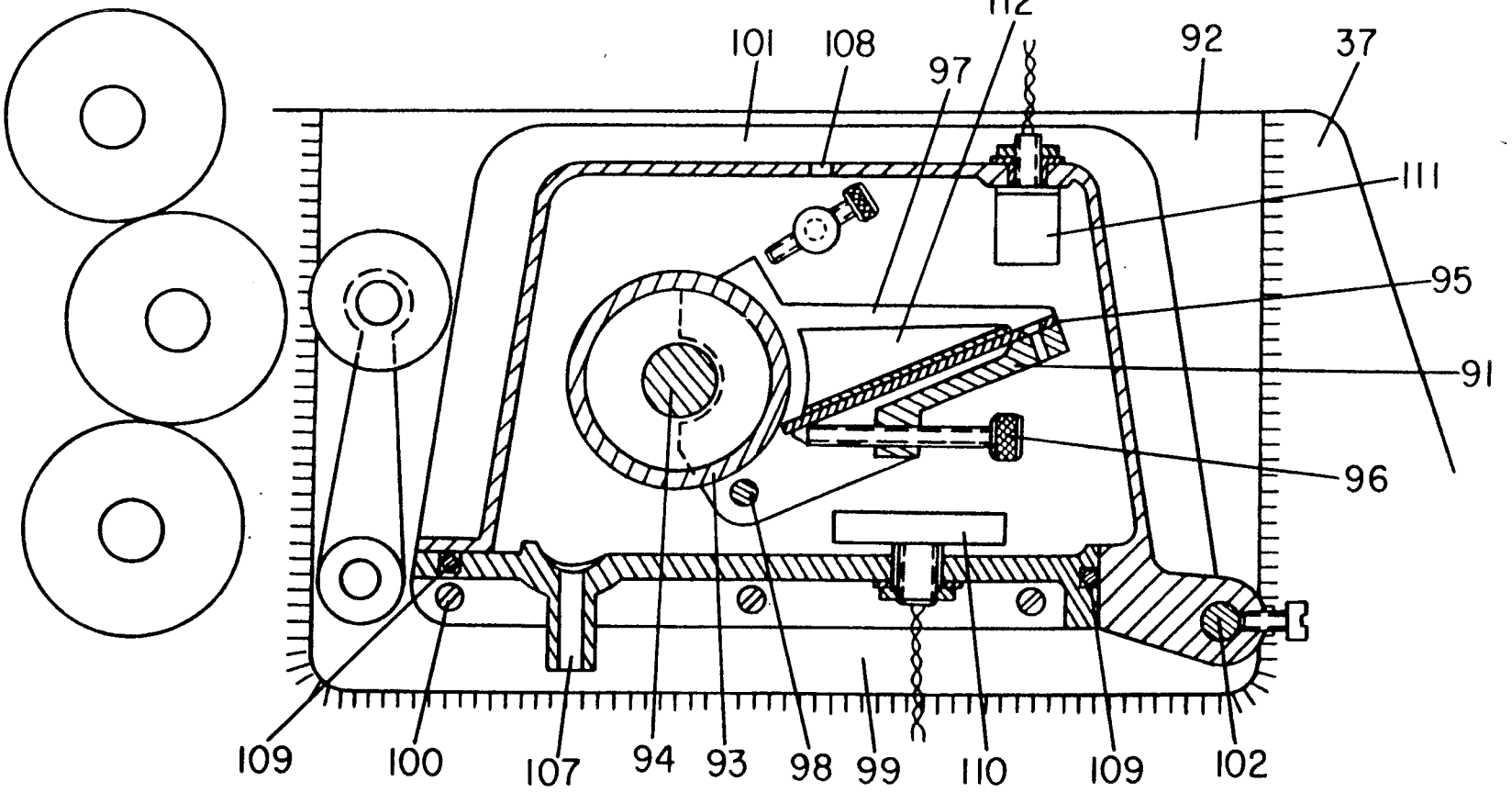
FIGS. 15 and 16 depict the cleaning of the ink fountain.

One of the cleaning operations which is long, tedious and difficult to carry out well is the washing of the ink fountains. When there is a change in the printing color, if the darker color follows the lighter color, an imperfect washing can be tolerated. But if the lighter color must follow the darker color, a yellow after a black for example, the washing of the ink fountain must be perfectly carried out. The drawing of FIG. 15 shows an ink fountain 91 incorporated into a printing press 37 on the frame of which the surface 92 has been finely tooled. The ductor roller 93 is driven by the shaft 94 which is set in motion by the usual device with an adjustable ratchet wheel (not shown but well-known). The blade of the ink fountain 95 is adjusted by adjustment screws 96 screwed into the frame 97 articulated on the axis 98. The side-frames 99 serving as spacers to the flanges of the printing press 37 is fixed on the former by the screws 100, with the interposing of a watertight point (not shown on the figure for clearness of the drawing). The closing cover 101 is blocked on the pivoting axis 102 at one end of which is placed a tangent wheel 103 of FIG. 16 linked to the axis 102 by a torque limiter made up of friction washers 204 and elastic washers 105. The endless screw 106, set in rotation by a motor (not shown for the clearness of the drawing) ensuring the tilting of the cover 101 by closing or opening it depending on the process of the washing program, or by immediate intervention depending on the needs of the operator. End of travel contacts (not shown for the clarity of the drawing but well known) stop the movement at the extreme positions of opening and closing.

The torque limiter ensures the protection of the motor and holds it on the closing of the cover 101 the sides of which are very precisely adjusted with the surfaces 92 are equipped with sliding watertight joints (not shown on the figure for the clarity of the drawing). On the side-frame 99 an orifice 108 ensures the putting at atmospheric pressure of the volume obtained after closing the cover 101.

Figure 16:
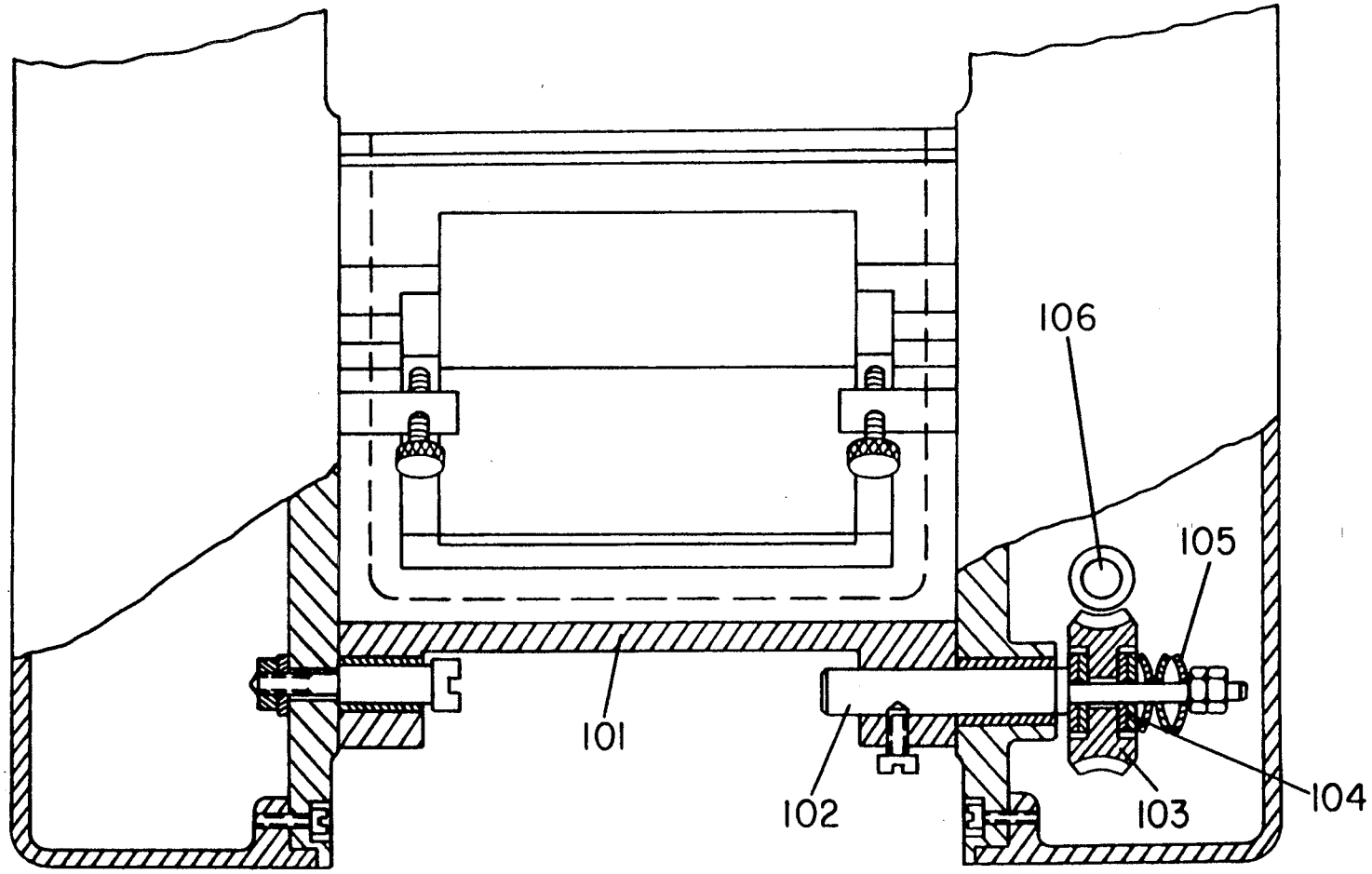

If the washing operation is selected, throwaway blade 112 is withdrawn by hand, removing a major portion of the ink of the ink fountain. Then, by selection of a program by the selector 56 of FIG. 13 or by manual working of the appropriate keys 59 of the control console 55, the motor activating the endless screw 106 FIG. 16 is set in motion, the cover 101 closes on the side wall 99 of FIG. 15, and comes to crush the watertight joints 109. The joints of the sides (not shown for clarity of the drawing) ensure the water tightness with the surface 92 of the flanges of the printing press 37. The end of travel stops the closing motion. The irreversibility of the endless screw 106 of FIG. 16 (associated with the torque limiter of the tangent wheel 103) keeps the watertight joints 109 of FIG. 15 compressed. The washing solution A is introduced by orifice 107 via the solvent reservoirs 44 of FIG. 13, by coordinated operation of electrovalve of the distributor block 46, the motor-pump 45 and electro-valve 52C. The filling-up having been completed, the level detector 111 of FIG. 15 stops the arrival of the product by closing the corresponding valve of the distribution block 46 of FIG. 13 as well as the electro-valve 52C. A generator of ultrasonic impulses (not shown or described but well known) makes the ultrasonic capsule 110 resonate which frees the pressure waves provoking a very powerful mechanical action on the ink particles which are diluting in the washing solution The stopping of the ultrasonic agitation is followed by the draining of the solution by orifice 107 and its return to the decantation tank 44 of FIG. 13 via the opening of the corresponding electro-valves.

Depending on the types of presses and their importance all or part of the means used could be employed without going beyond the framework of the invention. In the same manner, simplified equipment could be adapted and enables for example, from the blankets cleaning device, all the printing rollers and pressure cylinders to be cleaned by transfer. In this case, the press will be put in the "Printing" position by previously cancelling temporarily, for the length of this operation., the automatic stop device for no take-up of paper. In this position, the pressure cylinders, blanket and plate are in contact with the diluent poured above the inking unit is progressively transferred by means of the printing plate up to the cleaning device, the pressure cylinder is cleaned in the same way.

In the case of a rectro-verso "blanket against blanket" press or other, a blanket cleaning device can be installed on this second blanket. The pressure cylinders, depending on the layout of the press, can also take a cleaning device. All sorts of dispositions can be organized based on the concept of the invention and the basic means used to carry it out.

Without going beyond the framework of the present invention, in the case where the press has a blanket cleaner, the existing means on these devices can be used in combination to complete them and finish equipping in whole or in part the other functions offered by the invention. In the case of sheet-fed presses or rotating ones having printing units with several colors, the controls of the different printing units for all the functions will be preferably grouped together on a general control center.

The system described above is an automatic cleaning unit which uses the same means to carry out all the cleaning and maintenance operations necessary for printing presses.

An alternate embodiment of the invention relates more particularly to the cleaning of all the rollers an cylinders of the inking unit, of the inker, of the blankets and of the pressure cylinders as well as of the printing plate. In addition to the general cleaning activity, there is disclosed a series of operations for the maintenance and treatment of the rubber parts with the aim to increase their life span and preserving the original surface condition.

Cleaning and rinsing solutions are provided with specific chemical properties which clean very efficiently because of the action of the successive chemical reactions which have the effect of irreversibly separating the ink and its support. This separation effect is reinforced by the use of solutions containing anionic agents which prevent the ink, by electrostatic repulsion with the rubber-covered surfaces which are negatively charged by the absorption of the solution, from settling again on its support. These solutions are also non-flammable, decompose naturally, and are non-polluting for the environment and non-toxic on inhalation or on brief contact with the operator's hands. These advantages are a solution to the difficult problem caused by pollution due to the disposal of products which do not decompose naturally, and the negative consequences of their toxicity in relation to the human organism.

Simplified cleaning units are disclosed which do away with the use of the traditional ink recovery "scraper" and act by successively deconcentrating the destructed, neutralized and transformed ink film. The cleaning action carried out by a physical-chemical reaction avoids the need for any additional mechanical action such as, for example, that obtained by the use of a blotter, felt or other material, and gives a much better result. The simplifying of the cleaning attachments decreases their cost, and allows them to be more easily fitted onto all types of printing presses. Also their operating mode considerably simplifies the automating of all the cleaning operations.

Simplified attachments are provided for cleaning the blankets, printing plates, an pressure cylinders—giving a higher standard of cleaning. Inker cleaning attachments are provided based on a particular inking procedure.

The invention will be describe first with reference to the cleaning solutions employed, and then with reference to the apparatus employed.

The solution is made up of an ink diluting agent with a controlled action, which has the property of gelling by precipitation on the contact with the rinsing solution. A complex of additional agents ensures, at the same time, an improved dilution, the creation of an electro-static repulsive anti-resettling effect, and a measuring and limiting of the gelling so as to facilitate the evacuation of the rinsing solution.

The cleaning process is as follows: The ink film covering the inked surface is deeply impregnated and diluted by the cleaning solution. It is important that this diluted "ink-solution" mixture remains sufficiently viscous to permit a good mechanical action which occurs on the contact line from roller to roller, in a way which favors this mixture and does away with the need to drive the transfer roller of the cleaning unit against a particular roller or cylinder of the inking group.

The rinsing solution is supplied after this diluting action and immediately causes a microgelling of the "ink-solution" mixture by chemical precipitation and dispersion in the rinsing solution which is simply evacuated into the drains.

The dilution obtained by the solution keeps the coated ink film sufficiently cohesive to prevent liberate of the micro-particles of pigment which it contains, thus preventing their incrustration and imprisonment in the micro-porous rubber surfaces. The gelling process reinforces the cohesion of all the constituents of the ink film, neutralizes its adhesive power and separates it in an irreversible manner from its support.

In the traditional cleaning process, the ink film is solubilized then "scraped" and it is not possible to prevent the "freed" micro-particles of pigment from becoming imprisoned in the roughness of the micro-porous surfaces and from being gradually crushed. This major defect requires that the operator, when changing from dark colors to light colors, has to perform additional cleaning procedures. These procedures are unnecessary when cleaning is carried out using solutions which cause the ink film to become unstuck an then separate completely by chemical actions and reactions.

Contrary to the usual cleaning carried out by means of a scraper which collects a build-up of concentrated ink, improved cleaning of the present invention is carried out by successively deconcentrating the ink film, leaving on the cleaned parts a thin film of fresh rinsing solution which evaporates. This way of working also has the advantage of completely degreasing the cleaned surfaces which allows them to be re-inked more quickly and enables the balance of the "ink-water" emulsion to be obtained more swiftly in the case of offset printing.

To summarize, the chemical action caused by the cleaning and rinsing solutions amply replaces any other mechanical reaction and gives a much more positive result.

By way of an example, a formula for a concentrated cleaning solution in accordance with the characteristics of the invention is described below, giving very good results:

(a) −60% Ester polyglycolic of tall-oil; non ionic class 100% concentrated; surface tension 40+3 dynes centimeter; Ph 5; density at 20° centigrade 1.05.

The product has good diluting effect on oily inks and gels in contact with ordinary water which, in this version, represents the rinsing solution.

(b) −6% Dodecylbenzene sodium sulphonate An anionic damping agent which reinforces the ability to dilute and to separate by electro-static repulsion.

(c) −34% washing powder, preferably selected from among those which decompose naturally and are non-polluting such as those marketed by the Henkel Company, which contains, as well as a certain number of tensioactive agents and washing aids, a water-softening agent "zeolite A" and additives, replacing in its formula the phosphate function of the usual washing orders, so as to suppress the proliferation of micro-organisms caused by liquid waste. The pulverized powder at less than twenty microns has a complementary mechanical action and acts efficiently both on the diluting function and the separation of the film. It enables the gelling action of the ester. polyglycolic of tall-oil to be controlled and measured so that it can be evacuated easily by the rinsing solution.

It is obvious that other types of cleaning solution can be developed without going beyond the bounds of the present invention where the action, of the cleaning attachments is based on and closely linked to that of the cleaning solutions so as to carry out an efficient cleaning procedure with very simple means.

Figure 17:
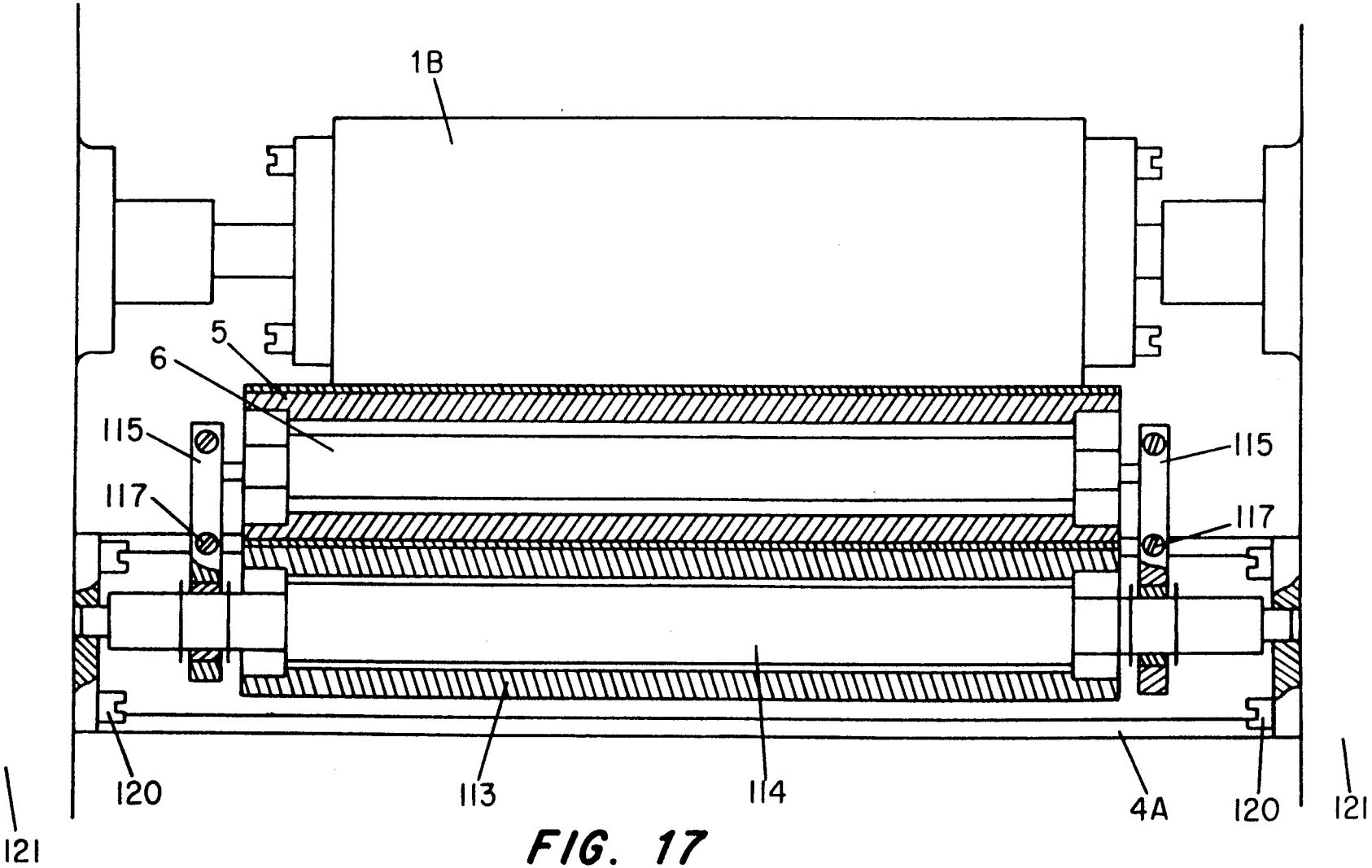
FIGS. 17 and 18 depict a simplified washing attachment for an inking unit.
Figure 18:
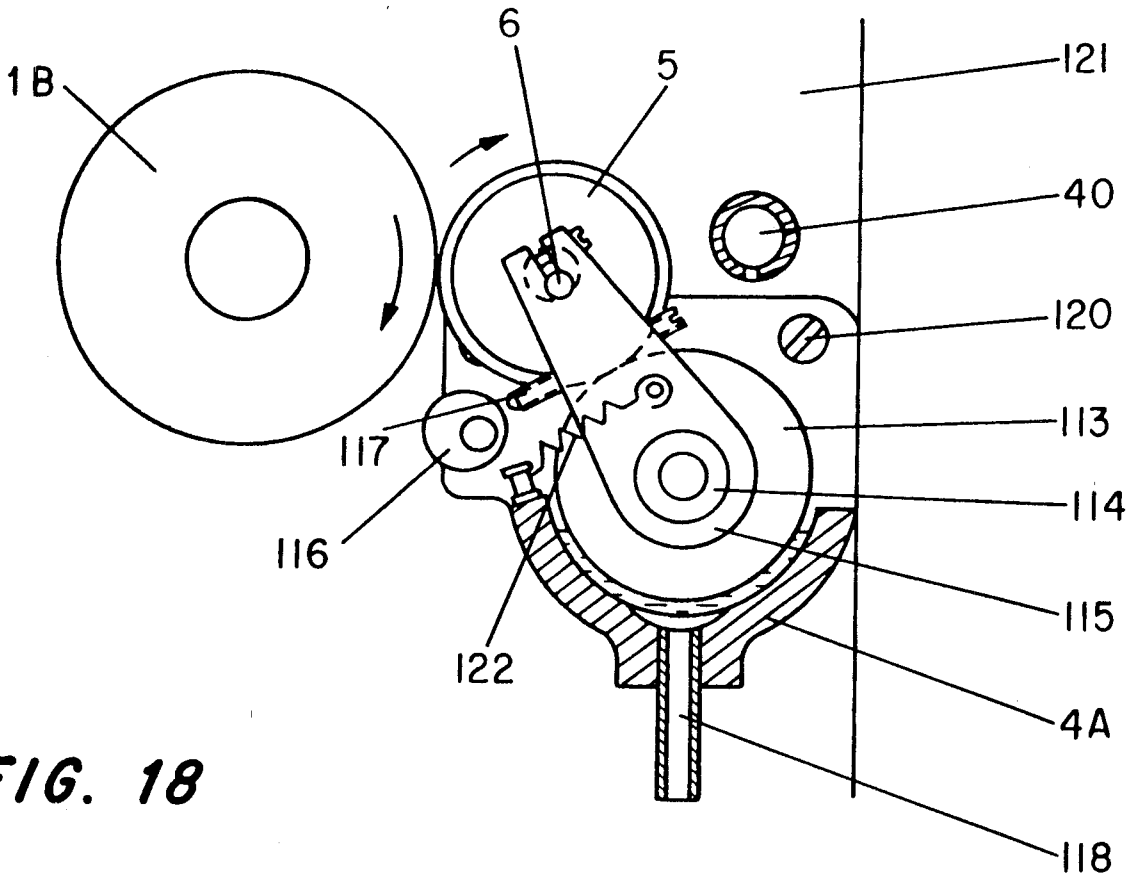

An example of a simplified washing attachment of the inking unit of a printing press doing away with the traditional recovery "scraper" is shown in FIGS. 17 and 18. The tray 4A of FIG. 17 is fixed on the frame of the printing press 121, and is fitted at one end with a drainage tube 118 of FIG. 18 through which the cleaning and rinsing solutions are evacuated. The paddle roller 113 turns on the axis 114 fixed to each end of the tray 4A. The rods 115, articulated on the axis 114 at one end, bear at the other end the off-center axis 6 on which the rubber covered transfer roller 5 turns. The adjustment of the off-center axis 6 enables the quantity of product which will be transferred by the roller 5 to be controlled by draining. The adjustment screws 117, screwed into the rods 115 rest on the off-center shaft 116. The rotation of shaft 116, enables the transfer roller 5 to come into contact with the ink table 1B. This maneuver can either be carried out manually or mechanically, if it is included in the automatic washing cycle. The return springs 122 stretch to keep the ink table 1B in continuous contact with the transfer roller 5.

The cleaning attachment is brought into use in the following way. The press is started and the off-center shaft 116 is maneuvered so as to bring the transfer roller 5 into contact with the ink table 1B, which is covered with ink film which needs evacuating. Upon contact, transfer 5 and paddle rollers 113 rotate while covered with cleaning solution, which is then transferred to all the rollers and cylinders which make up the inking unit. The ink film covering everything becomes impregnated with it and the ink becomes diluted. After several turns of the press, the rinsing solution is distributed through watering ramp 40 to achieve a complete deconcentration of the amalgam "cleaning solution-ink," thus permitting a complete washing and degreasing procedure. The drainage tube 118 enables the evacuation of the rinsing solution by suction with the "ink-cleaning solution" residues dispersed therein. When the cleaning operation is finished, the off-center shaft 116 is maneuvered so as to move the cleaning attachment away from the inking group.

Figure 19:
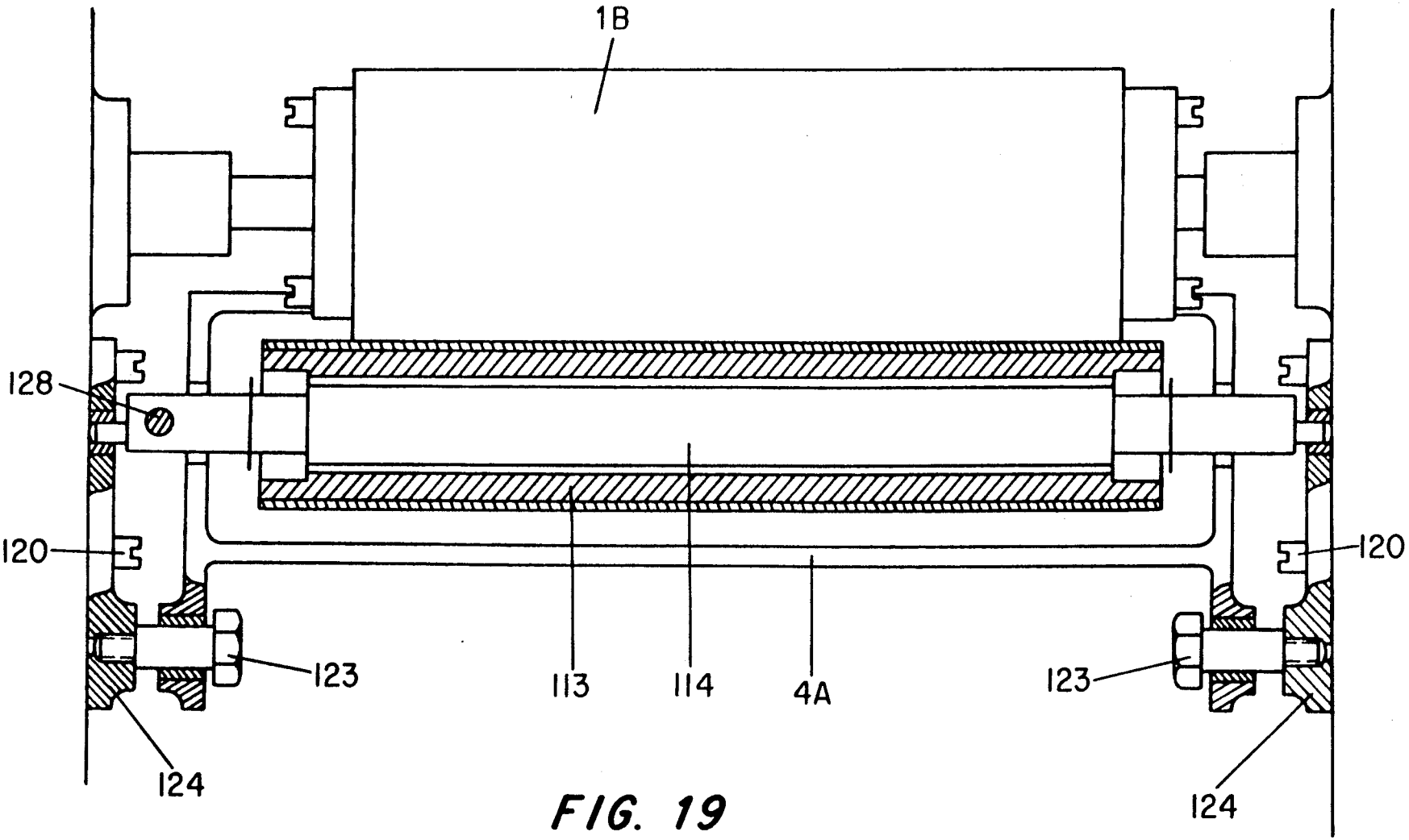
FIGS. 19 and 20 depict another type of cleaning unit for an inking unit.
Figure 20:
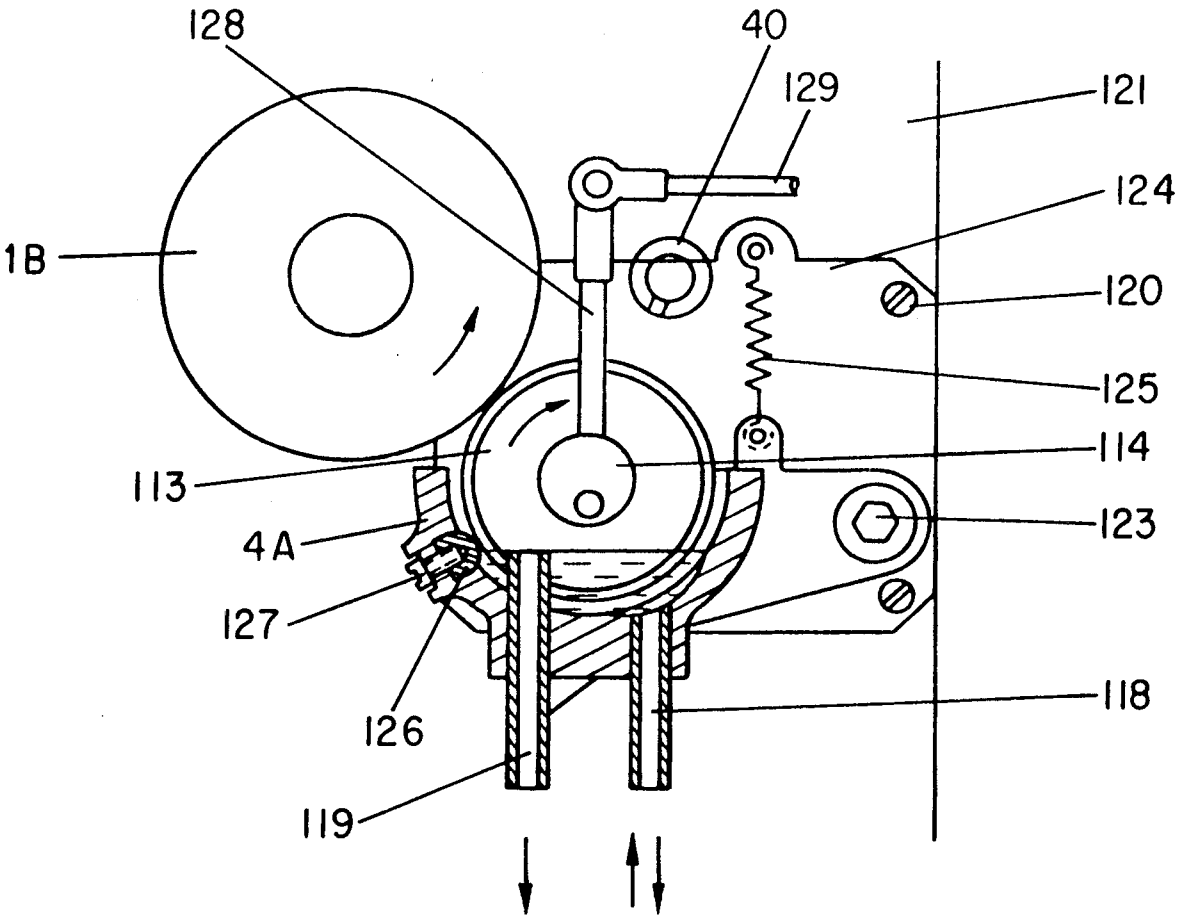

Depending on the layout of the printing process which is to be fitted, another type of cleaning unit for an inking unit of a printing press is shown in FIGS. 19 and 20. The washing tray 4A of FIG. 20 is articulated on pins 123 screwed into bearings 124 which are fixed on the frame 121 of the printing press by screws 120. The drainage pipe 118 enables the washing tray 4A to be filled and emptied, and the levelling tube 119 keeps the level of the cleaning and rinsing solutions constant, by suction, during the impregnation and deconcentration periods. The paddle roller 113 turns on the off-center axis 114, and is maneuvered by lever 128 manually or mechanically activated by the rod 129 to enable ink table 1B and the paddle roller 113 to come into contact. The return springs 125 keep the washing tray 4A constantly against the paddle roller 113 by means of the wiping rule 126 fixed by the screws 127 on the washing tray 4A.

The attachment is brought into use in the following way. The movement of the off-center axis 114 by the lever 128 brings the paddle roller 113 into contact with the ink table 1B which makes it turn. From watering ramp 40, the cleaning solution is distributed on the paddle roller 113. The wiping rule 126 limits the quantity of solution transferred to the ink table 1B of the inking unit which is to be cleaned with the excess filling the washing tray 4A. The ink film of the inking unit becomes impregnated with the washing solution which dilutes it. After a few turns of the press, the rinsing solution is supplied by the drainage tube 118, the level being maintained by the levelling tube 119, by suction, so as to obtain a total deconcentration of the "cleaning solution-ink" amalgam, thus permitting a complete cleaning and degreasing operation. When the rinsing is finished, the drainage tube 118 enables, by suction, the combination rinsing solution and "ink-cleaning solution" residues to be evacuated into the drain. A set of valves (not shown) enables the washing tray 4A to be filled or empties by the drainage tube 118. When the cleaning operation is finished, the off-center shaft 114 is operated so as to move the cleaning attachment away from the inking unit.

Figure 21:
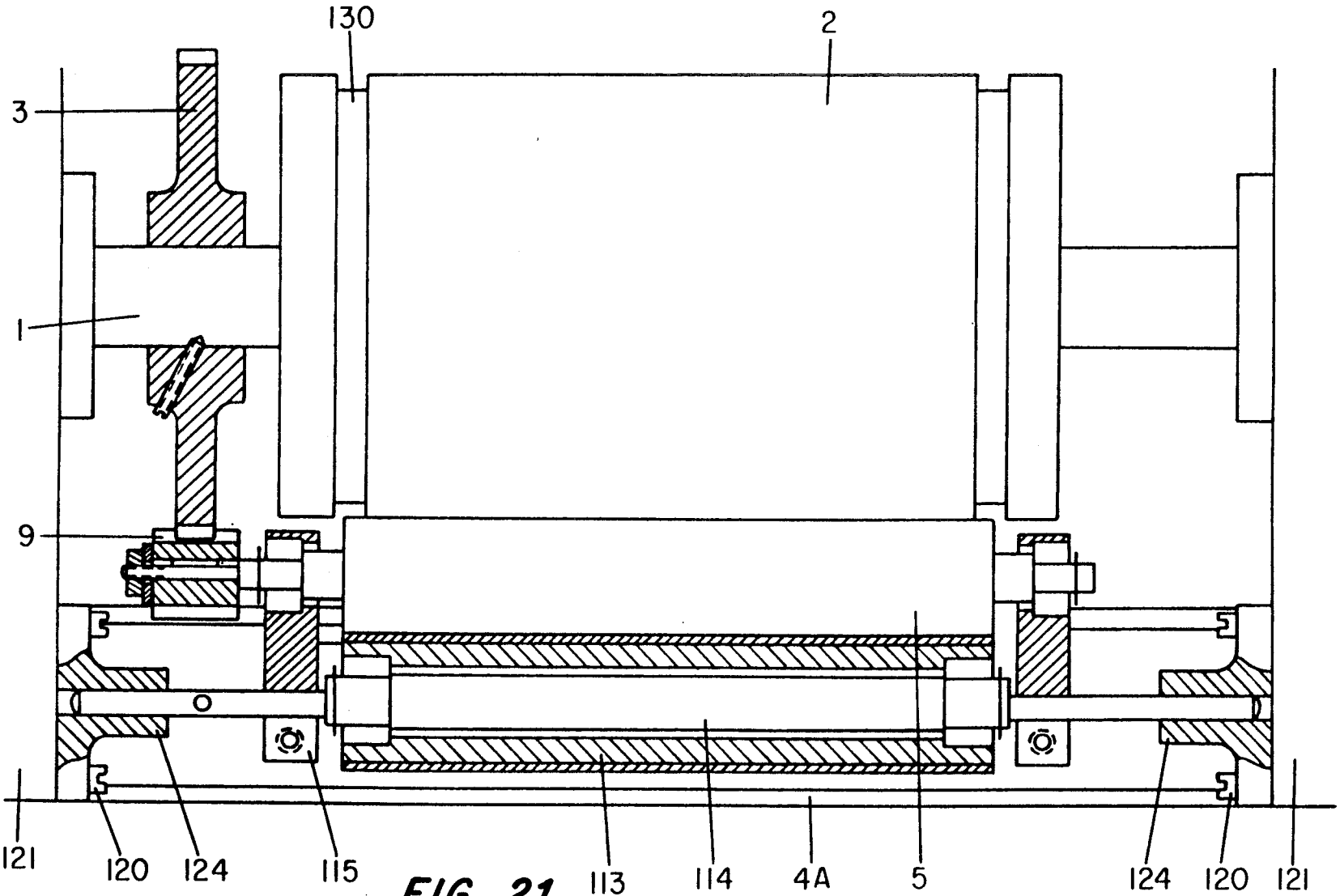
FIGS. 21 and 22 depict a cleaning attachment for use in cleaning a blanket.
Figure 22:
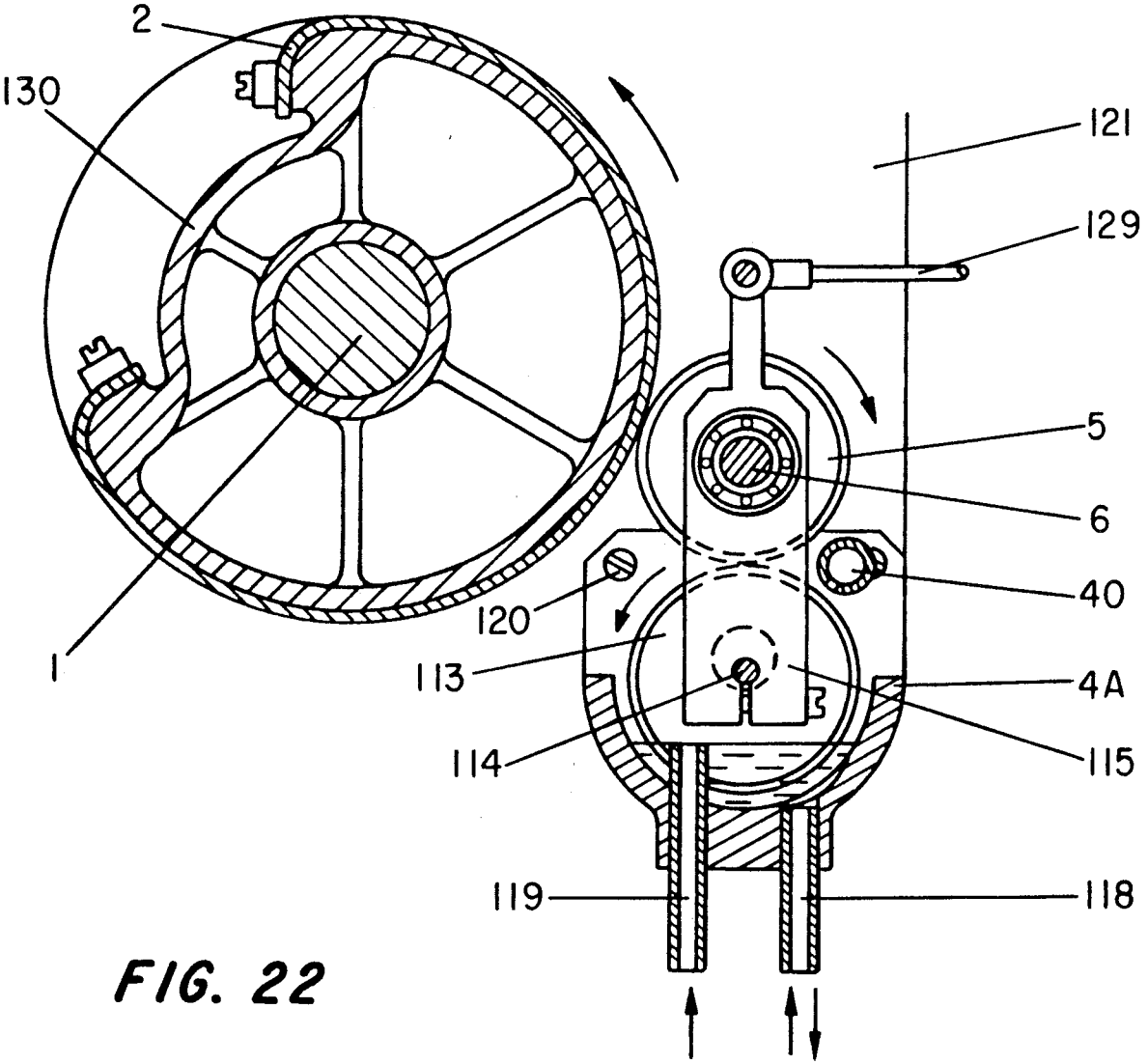

FIGS. 21 and 22 show an example of a cleaning attachment used for cleaning a blanket. The washing tray 4A of FIG. 21 is fixed on the frame 121 of the printing press by the fixing screws 120 and has at each end a bearing 124 in which rotates the off-center axis 114 on which the paddle roller 113 turns. On the rods 115, fixed at one end of the off-center axis 114, turns, at the other end, the transfer roller 5 which can be put into contact with the blanket 2. The adjustment of the off-center axis 114 determines the pressure between the paddle roller 113 and the transfer roller 5 so as to measure the solutions transferred towards the blanket 2. The transfer roller 5 has, keyed to one end, the gear 9 drive into rotation by the gear 3 wedged on the shaft 1 of the blanket-bearing bearing cylinder 130. The ratio of the number of teeth of the gears 3 and 9 is calculated in such a way so as to have a greater circumferential speed of the transfer roller 5 in relation to that of the blanket-bearing cylinder 130. This difference in speed brings about a considerable mechanical cleaning action, by friction, which adds to the action of the cleaning and rinsing solutions.

The movement of the maneuvering rod 129 may be controlled by a simple attachment (not shown for purposes of clarity), activated manually or mechanically (in the case of an automatic cycle). Actuation of maneuvering rod 129 causes rods 115 to pivot with the off-center axis 114 in the bearings 124, bringing the transfer roller 5 and the blanket 2 slightly into contact. The watering ramp 40 distributes the cleaning solution measured by the draining of the paddle roller 113. The excess fills the washing tray 4A. The cleaning solution is thus transferred onto the blanket 2 where it penetrates and dilutes the ink needing to be evacuated.

After a few turns of the press, the rinsing solution is sent into the washing tray 4A via the drainage tube 118 by the washing unit as described above. The levelling tube 119 keeps, by suction, a constant level in the washing tray 4A where, by the paddling of the paddle roller 113, the "cleaning solution-ink" amalgam becomes deconcentrated, thus enabling complete cleaning and degreasing to be carried out. At the end of the rinsing, the drainage tube 118 enables, by suction, the evacuation to the drains of the rinsing solution, in which the "ink-cleaning solution" residues are dispersed, to be carried out, as in the previous example. When the cleaning action is terminate the maneuvering rod 129 is activated to stop the cleaning attachment which moves away from the blanket-bearing cylinder 130.

Figure 23:
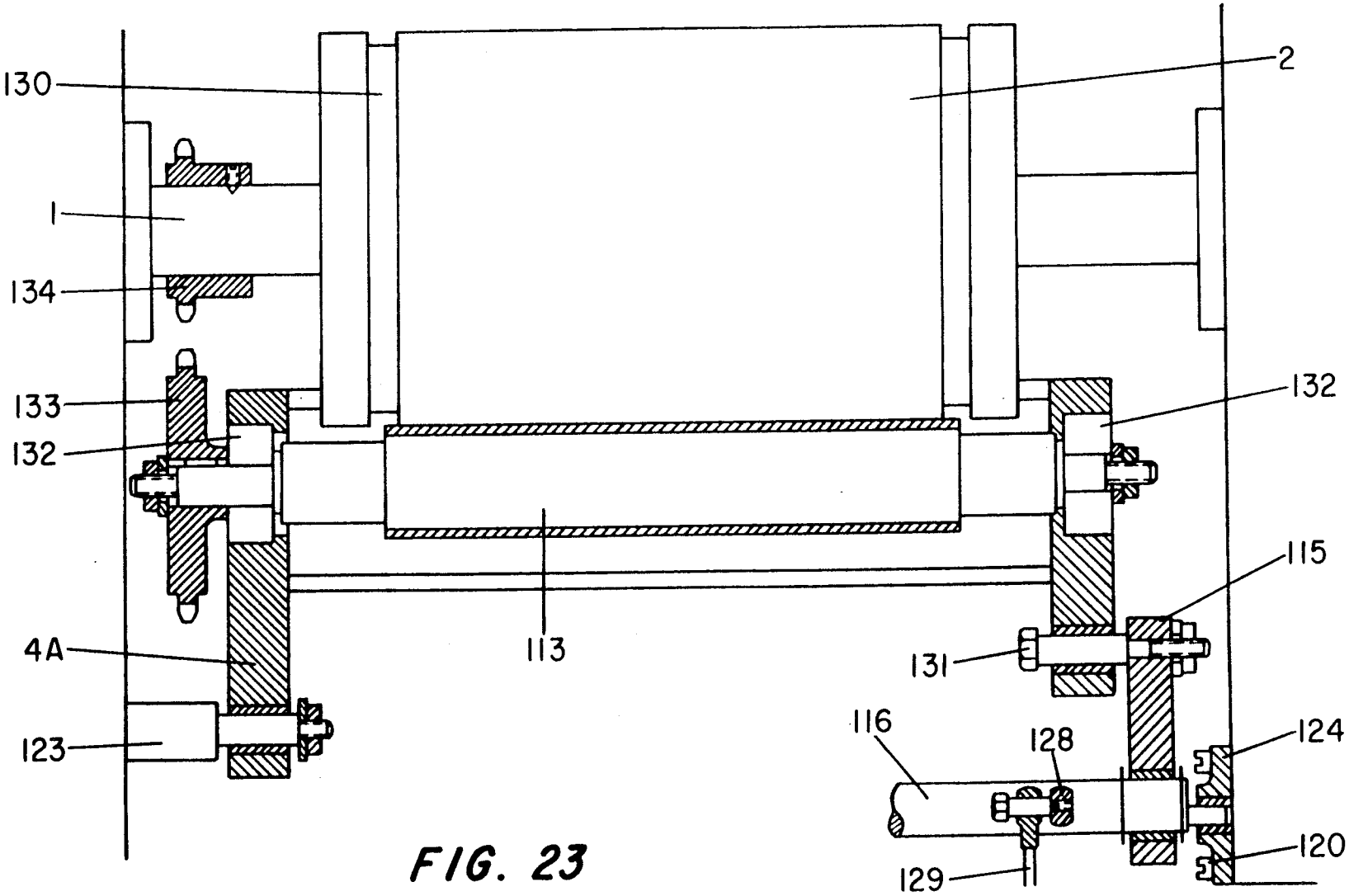
FIGS. 23 and 24 depict another type of blanket-cleaning attachment.
Figure 24:
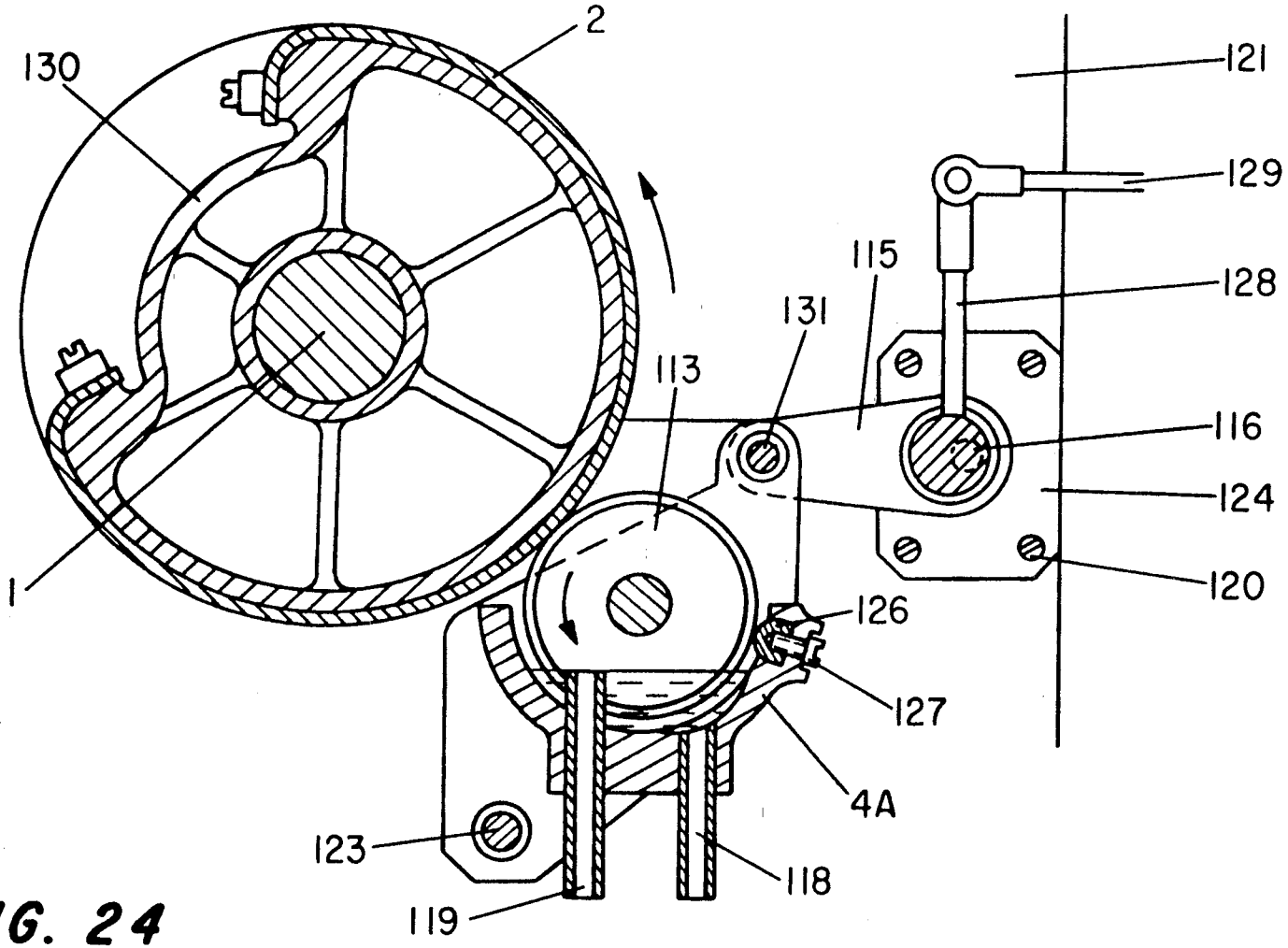

FIGS. 23 and 24 show another example of a blanket-cleaning attachment, where the paddle roller 113 of FIG. 24 turns in the opposite direction to the blanket-bearing cylinder 130. Washing tray 4A of FIG. 23 is articulated on frame 121 of the printing press by pins 123, the paddle roller 113 and borne by the ball-bearings 28. Paddler roller 4 is sheathed in an elastomer. Its surface is very rough. It has keyed to one end the sprocket wheel 133. Sprocket wheel 134 is mounted to shaft 1 of blanket-bearing cylinder 130 and is linked to the sprocket 133 by a chain held tight by a cam follower, not shown here for the simplicity of the drawing. The off-center shaft 116 pivots in bearings 124 fixed on frame 121 of the printing press by the attachment screws 120, and is driven into rotation by means of the lever 128 and the maneuvering rod 129 (the movement of which, controlled in amplitude by a simple attachment not shown to simplify the drawing).

The rotation of the off-center shaft 116 sets in movement the linking rods 115, articulated on the axes 131, fixed on the washing tray 4A. The latter can thus pivot around the pins 123 bringing paddle roller 113 into very slight contact with the blanket 2. The wiping rule 126 kept in the washing tray by the attachment screws 127, is in permanent contact with the paddle roller 113 in such a way as to avoid an excessive transfer of the solution towards the blanket 2.

The cleaning operation is carried out as follows: the cleaning solution coming from the cleaning unit as described above is pushed through the drainage tube 118 and fills the washing tray 4A, the upper limit of which is controlled by the levelling tube 119 by suction. The printing press is started, causing the paddle roller 113 to rotate by means of the sprockets 133 and 134 FIG. 23 and their chain. The control movement of the rod 129 brings the paddle roller 113 into slight contact with the blanket 2, causing a vigorous friction which combines with the action of the cleaning solution to penetrate and dilute the ink needing to be evacuated. After operating the press for a few minutes, the cleaning solution is replaced, in the washing tray 4A, by the rinsing solution. At the end of the rinsing, the drainage tube 118 enables, by suction, the rinsing solution in which the "ink-cleaning solution" residues are dispersed to be evacuated to the drains as in the previous example. When the rinsing operation is finished, the control rod 129 is activated to stop the cleaning attachment which moves away from the blanket-bearing cylinder 130.

The efficiency of the cleaning in this version depends on the fact that the ink and impurities are driven in the opposite direction by the paddle roller 113 to prevent them from being rolled onto the blanket 2. When the rinsing is finished, the washing tray 4A has been emptied of the rinsing solution, the movement of the wiping rule 126 allows the paddle roller 113 to dry. The present invention allows the press to begin printing a few seconds after this rapid cleaning operation.

This way of proceeding does away with the use of fibrous complexes which are efficient but which are often not of any help because they are too moist. These very efficient cleaning attachments are also perfectly suitable for the cleaning of inking units and pressure and blanket cylinders and could, depending on the layout of the different presses which are to be fitted and the choice of the fitter, replace those described with the help of FIGS. 17, 18, 19, 20, 21 and 22.

Figure 25:
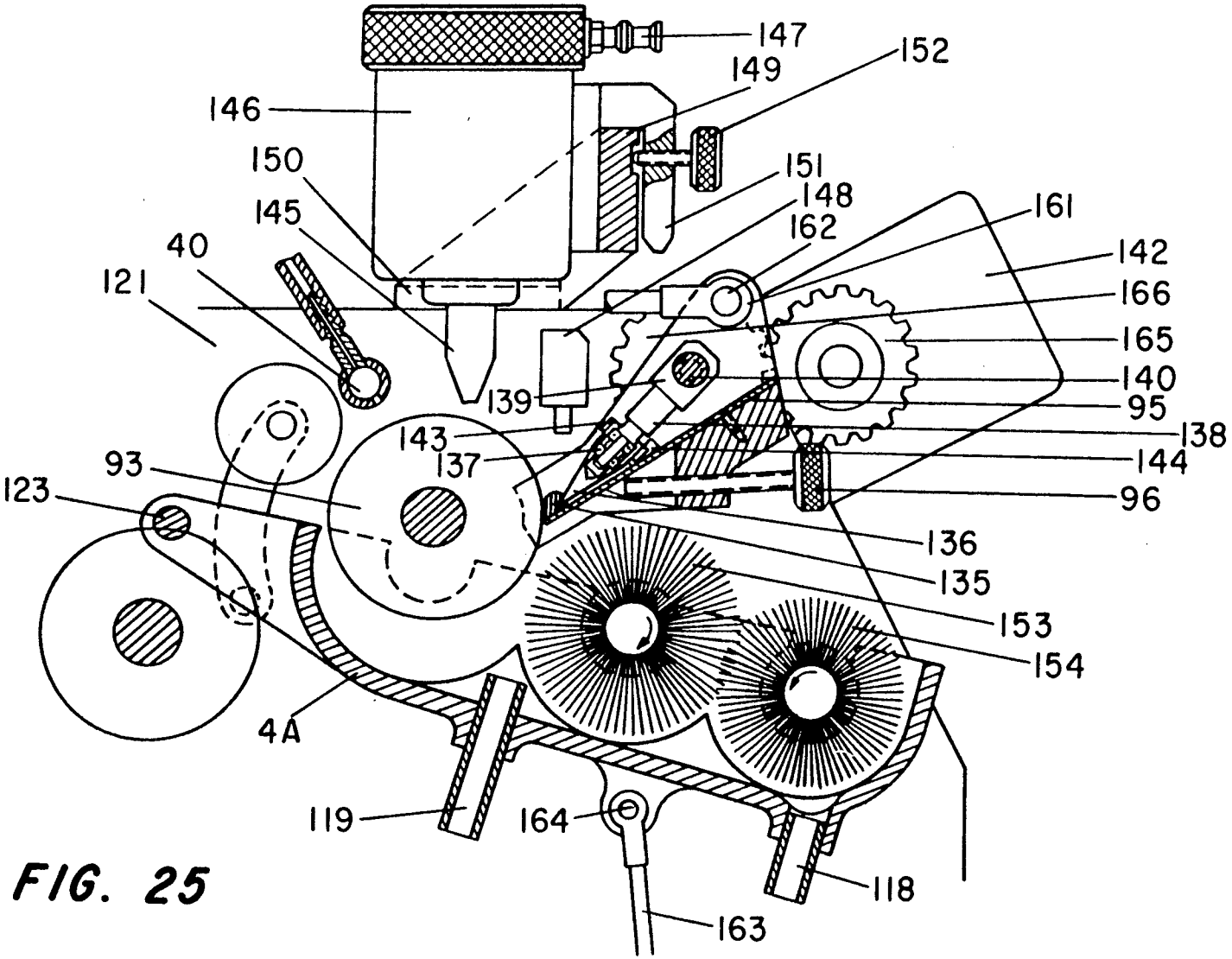
FIGS. 25 and 26 depict an inker fitted with a washing attachment and an automatic ink distributor.
Figure 26:
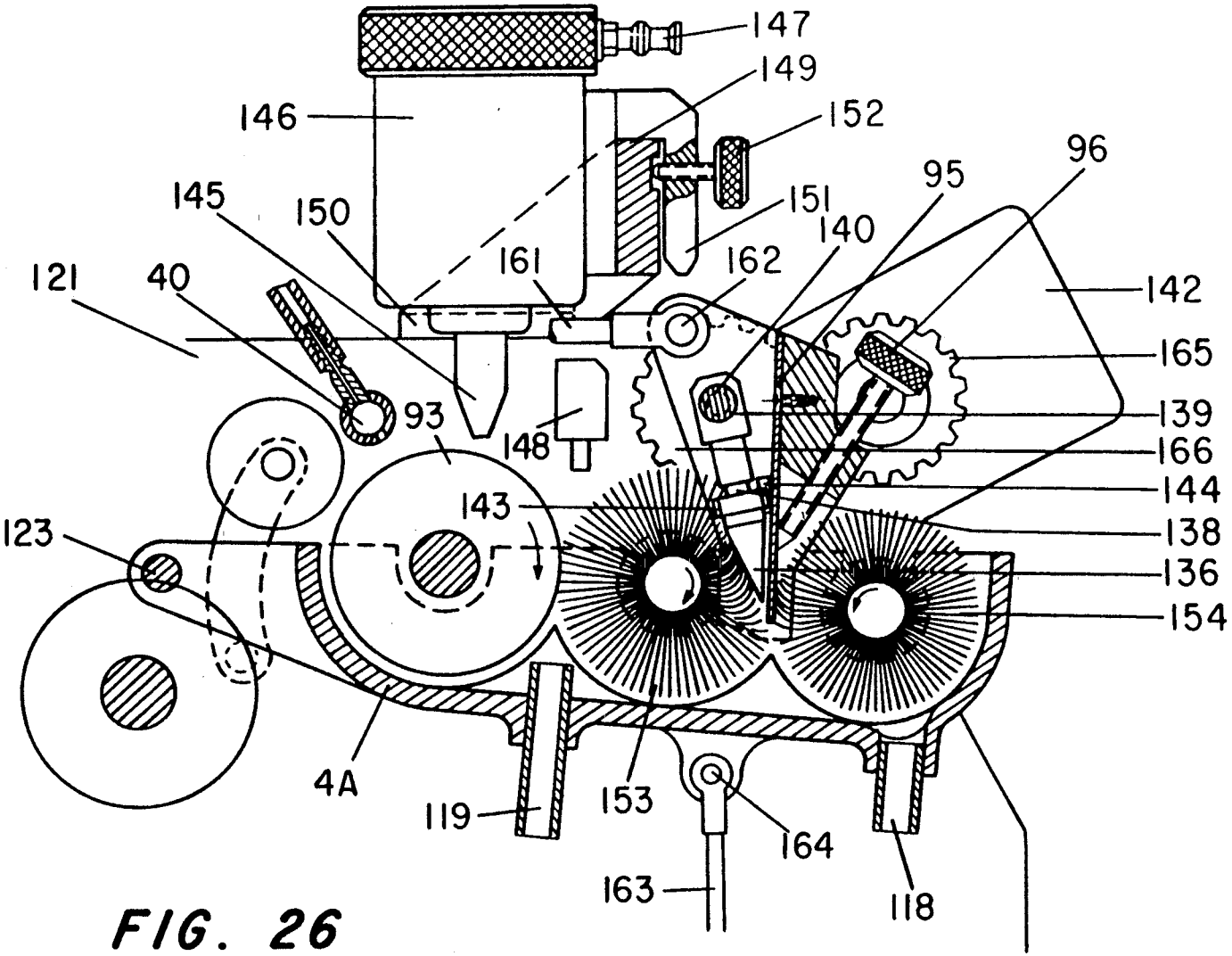
Figure 27:
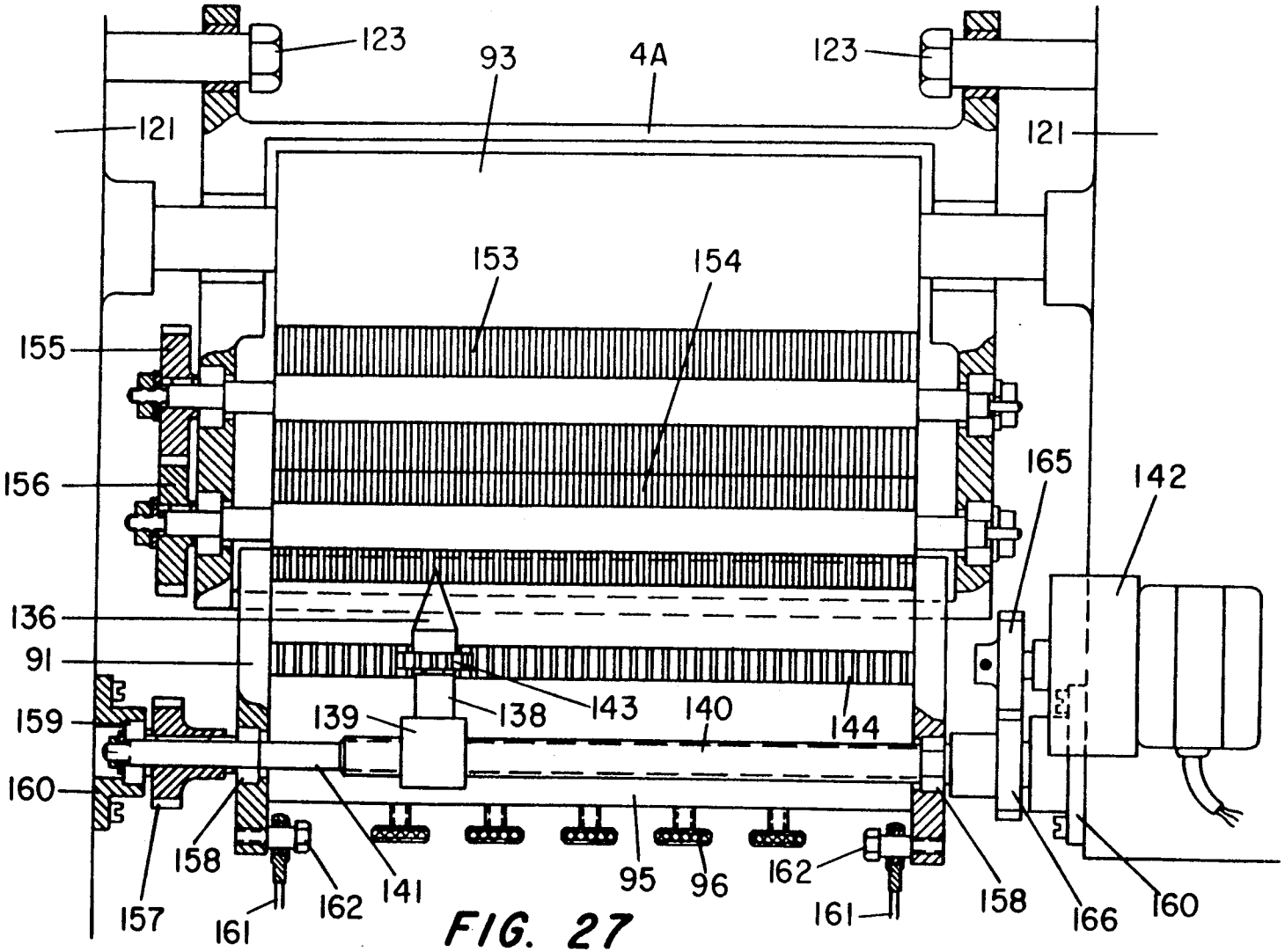
FIG. 27 is a top view of FIG. 26.

FIGS. 25, 26, and 27 show an inker fitted with a washing attachment and an automatic ink distributor simplifying the washing.

The ductor roller 93 of FIG. 25 is driven into rotation by the conventional mechanism of the printing press, and turns inside the washing tray 4A, articulated by the pins 123 screwed on the frame 121 of the printing press. The blade of the inker 95 is pressed on the ductor roller 93 by the adjustment screws 96 and adjusts the ink film which is necessary for printing. The ink roller 135 which is very small in size (a few millimeters) is homogenized and spread out by the distributor 136, rotating at ball bearings borne by the axis 137. The latter is fitted with a tapped bearing 139 moving on the maneuvering screw 140 which drives, in a to and fro movement all along the inker, the distributor 136 in response to action of the moto reducer 142, the gears 165 and 166 and the end of travel reverse switches (not shown here for the clarity of the drawing). The non-threaded zones 141 of the screw 140 enable the mixer 136 to be stopped at the end of travel during the washing operation. The distributor 136 has a gear 143 meshed with a rack 144 fixed on the inker blade 95, which makes it rotate when it is moved by the movement of the screw 140.

These translation and rotation movements ensure an excellent homogenization of the ink roller 136 as well as a perfect distribution in the vee of the inker. The ink is distributed on the ductor 93 by the ejector 145 of the ink distribution reservoir 146 and is supplied with compressed air by the attachment of a quick link on the male end 147 joined to a supply of low pressure air. A control valve (not shown) is piloted by the level capacity sensor 148 and works, depending on the automatic cycle which controls it, to bring the ink when needed. The ink distributor reservoir 146 can be moved on the slide 149 fixed on the supports 150 and kept in place by the strap 151 and the tightening screw 152; during the printing, it will be positioned where there is the greatest use of ink and if required can be coupled to another distributor reservoir fitted in the same way. The rapid mounting of the ink distribution reservoirs 146 allows a rapid change of colors, the same reservoir always being full of the same ink. In the washing tray 4A, brushes 153 and 154 are long-haired, semi-rigid and densely tufted brushes which turn in opposite directions. The diameter of these brushes are not the same, so when driven by gears 155 and 156 there is a rubbing and cleaning of the one against the other.

The gear 157 of FIG. 27 is wedged on the screw 140 of the mixer distributor 136 and drives the brushes 153 and 154 when the tray 4A of FIG. 26 is put in the washing position. In this way, the meshing of the motor gears 157 of FIG. 27 and the gears 155 is obtained. Consequently, the brushes 153 and 154 rotate when the moto reducer 142 starts operating. The maneuvering screw 140 carries the body of the inker 91 by turning on the ball-bearings 158. The ends of the screw 140 are fitted with ball-bearings 160 mounted in bearings 160 fixed on the frame 121 of the printing press. This layout enables the inker 91 to be tilted while at the same time keeping the maneuvering screw 140 rotating, so as to move it from the printing position of FIG. 25 to the washing position of FIG. 26—taking advantage of the action of the moto reducer 142 of FIG. 27 to start the washing brushes 153 and 154 rotating. The tilting is obtained by the manual or mechanical maneuvering in an automatic washing cycle, of the rods 161 of FIG. 25 articulated on the pins 162. The amplitude of the inker's movement 91 is limited by the adjustable stops, not shown here for the clarity of the drawing. In the same way, the maneuvering of the rods 163 articulation on the pins 164 causes the washing Tray 4A to tilt from the printing position of FIG. 25 to the washing position of FIG. 26 or the opposite. This movement is limited in amplitude by adjustable end stops, not shown here for the simplicity of the drawing.

The putting into operation of the attachment takes place as follows: Ink coming from the distributor 146 is placed on the ductor 93 distributed over the full length of the inker 91 due to the combined movements of the rolling of the blade 95 and the mixer distributor 136. The capacity sensor 148 keeps the ink roller 135 at as low a level as possible to have good printing and reduce to a minimum the quantity o residual ink needing to be evacuated. With the washing operation selected, the press is started up an the movement of the rods 161 tilts the inker into the washing position FIG. 26. The maneuvering of the rods 163 brings the washing tray 4A into the high position causing the brushes 153 and 154 to go into slow rotation due to the meshing of the gears and of FIG. 27. As soon as the washing cycle has started, the moto reducer 142 is only allowed to turn in one direction: the one which favors a better cleaning of the blade of the inker 95 by forcing the brushes 153 and 154 to push the ink residues into the washing tray 4A. The ink distributor mixer 136 is pushed into the clearance groove 141 where it is immobilized. The distributor ramp 14 of FIG. 10 sends the cleaning solution onto the ductor 93. The solution is transferred to the brush 153, which cleans the top of the blade as well as the distributor mixer 136, then towards the brush 154 which cleans underneath of the blade 95 of the small drips of ink formed during the printing. The brush 153 makes contact with the ductor roller 93 and carries out a vigorous cleaning of the latter while at the same time cleaning the blade 95. After a few turns of the machine, the rinsing solution is sent into the washing tray 4A via the drainage tube 118 where its level is kept constant by the leveling tube 119, by suction from a cleaning unit as described above. When the rinsing is finished, the drainage tube 118 enables, by the suction of the cleaning unit, the evacuation to the drains of the rinsing solution in which the "ink-cleaning solution" residues are dispersed, to be carried out as in the previous example. When the cleaning action is finished, the rods 163 and 161 are maneuvered, the washing tray 4A moves into the low position and the inker moves into the printing position as shown in FIG. 25. The moto reducer 142 reserves the rotating direction of the maneuvering screw 140, the micro-contact end-stop no longer being put out of action by the cleaning cycle. Distributor mixer 136 engages the maneuvering screw 140 which enables it to take up the to and fro movement necessary for the correct operating of the inker.

In the instances where conservative printers prefer to continue cleaning their presses by means of usual hydrocarbonate solvents or diluents, the decanting tray of FIGS. 20 and 21 which equips the cleaning and treatment units can be replaced by a distillation tray taking the former's place in the unit's operating cycles so as to enable in this way also and in this sort of case the pollution of the environment to be limited.

The cleaning and rinsing solutions which decompose naturally and are non-polluting used to illustrate the functioning of this addition, can well replace in their use those described in the above and enable the number of functions of the cleaning unit to be substantially reduced by avoiding the additional operations caused by changing from light to dark inks and by preventing, by their repeated use, the clogging of inked rubber-covered surfaces.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. An improved means for cleaning a printing press of the type having a plurality of printing press components, including inking rollers, printing blankets, and printing plates, comprising:

a plurality of different cleaning fluids each specially adapted for cleaning particular printing press components including said inking rollers, printing blankets, and printing plates;

means for selectively dispensing a selected one of said plurality of fluids to selected ones of said inking rollers, said printing blankets, and said printing plates, without delivery to nonselected others of said inking rollers, said printing blankets, and said printing plates; and a controller for automatically coordinating the dispensation of selected ones of said plurality of different cleaning fluids in a predetermined pattern to selected ones of said inking rollers, said printing blankets, and said printing plates, without delivery to nonselected others of said inking rollers, said printing blankets, and said other printing plates.

2. In a printing press having a number of components including inking rollers, printing blankets, printing plates, pressure cylinders, and inking fountains, which cooperate together to print images on paper sheets, an improved means of cleaning the printing press, comprising:

a plurality of reservoirs, each having a specially adapted for cleaning a particular printing press component, including:

a first reservoir having a first fluid specially adapted for cleaning rollers and printing blankets;

a second reservoir having a second fluid specially adapted for daily maintenance of rollers and printing blankets;

a third reservoir having a third fluid specially adapted for deglazing ink dried on rollers and printing blankets;

a fourth reservoir having a fourth fluid for cleaning printing plates;

a fifth reservoir having a fifth fluid for dampening printing plates;

means for selectively dispensing a selected solvent from said reservoirs to a particular location within said press; and means for agitating said selected solvent to enhance the cleansing action.

3. A system according to claim 2, wherein said first fluid includes an aliphatic diluent of the paraffin type with a low aromatic rate.

4. A systems according to claim 2, wherein said second fluid includes an alkyd resin, anti-ultraviolet agents, and anti-oxidants.

5. A system according to claim 2, wherein said third fluid includes benzilic alcohol, white spirit, and butanol.

6. A system according to claim 2, wherein said fourth fluid includes Arabic gum, sodium benzoate, and water.

7. A system according to claim 2, wherein said fifth fluid includes phosphoric acid, Arabic gum, and ammonium.

8. A system according to claim 2, wherein said first fluid includes methylecellulose carboy, magnesium nitrate, ispropilic alcohol, a tensioactive agent, caustic soda, and water.

9. A system according to claim 2, wherein said first fluid includes an aliphatic diluent of the paraffin type with a low aromatic rate, and a conductor agent.

10. A system according to claim 2, wherein said second fluid includes a heavy plasticizer, an anti-oxidant, and an anti-ultraviolet agent.

11. A system according to claim 2, wherein said second fluid includes a heavy plasticizer, an anti-oxidant, an anti-ultraviolet agent, and a substance which provides strong viscosity, internal adhesion, and mechanical and shearing action to said second fluid.

12. A system according to claim 2, wherein said second fluid includes a heavy plasticizer, an anti-oxidant, an anti-ultraviolet agent, and a sandoly additive which gives said second fluid strong viscosity, internal adhesion, and mechanical and shearing action.

13. A system according to claim 2, wherein said second fluid includes a heavy plasticizer, an anti-oxidant, an anti-ultraviolet agent, and an isophthalic alkyd resin.

14. A system according to claim 2, wherein said second fluid includes a lime carbonate absorbing agent.

15. A system according to claim 2, wherein said second fluid includes a barium sulfate absorbing agent.

16. A system according to claim 2, wherein said fourth fluid includes arabic gum, water, and a bactericide agent.

17. A system according to claim 2, further comprising a sixth reservoir having a sixth fluid for maintaining the condition of microporous surfaces on said rollers and printing blankets including aliphatic diluent, iosphthalic alkyd resin, lime carbonate, and monomer plasticizer.

18. A system according to claim 2, wherein at least one of said first through fifth fluids includes a thickening and flocculent agent, a bactericide agent, an agent for accelerating dilution, and a biodegradable washing powder.

19. A system according to claim 2, wherein at least one of said first through fifth fluids includes a thickening and flocculent agent, a bactericide agent, an agent for accelerating dilution, a biodegradable washing powder, and a tensioactive agent.

20. A system according to claim 2, wherein at least one of the said first through fifth fluids include anionic agents, which are absorbed by rubber-covered surfaces, and which electrostatically repel ink from attaching to said rubber-covered surfaces.

21. A system according to claim 2, wherein at least one of said first through fifth fluids includes gelling agents for precipitating ink, and an electrostatic agent which is absorbed by rubber-covered surfaces and which electrostatically repels ink from attaching to said rubber-covered surfaces.

22. A system according to claim 2, wherein at least one of said first through fifth fluids includes ester polyglycolic of tall-oil, dodecylbenzene sodium sulphonate, and biodegradable washing powder.

23. In a printing press having a number of components including inking rollers, printing blankets, printing plates, pressure cylinders, and inking fountains, which cooperate together to print images on paper sheets, an improved means of cleaning the printing press, comprising:

a plurality of reservoirs, each having a fluid specially adapted for cleaning a particular printing press component, including:

a first reservoir having a first fluid specially adapted for cleaning rollers and printing blankets;

a second reservoir having a second fluid specially adapted for daily maintenance of rollers and printing blankets;

a third reservoir having a third fluid specially adapted for deglazing ink dried on rollers and printing blankets;

a fourth reservoir having a fourth fluid for cleaning printing plates;

a fifth reservoir having a fifth fluid for dampening printing plates; and means for selectively dispensing a selected fluid from said reservoirs to a particular location within said press.

24. A system according to claim 23, wherein said first fluid includes an aliphatic diluent of the paraffin type with a low aromatic rate.

25. A systems according to claim 23, wherein said second fluid includes an alkyd resin, anti-ultraviolet agents, and anti-oxidants.

26. A system according to claim 23, wherein said third fluid includes benzilic alcohol, white spirit, and butanol.

27. A system according to claim 23, wherein said fourth fluid includes Arabic gum, sodium benzoate, and water.

28. A system according to claim 23, wherein said fifth fluid includes phosphoric acid, Arabic gum, and amonium bichromate.

29. A system according to claim 23, wherein said first fluid includes methylecellulose carboy, magnesium nitrate, ispropilic alcohol, a tensioactive agent, caustic soda, and water.

30. A system according to claim 23, wherein said first fluid includes an aliphatic diluent of the paraffin type with a low aromatic rate, and a conductor agent.

31. A system according to claim 23, wherein said second fluid includes a heavy plasticizer, an anti-oxidant, and an anti-ultraviolet agent.

32. A system according to claim 23, wherein said second fluid includes a heavy plasticizer, an anti-oxidant, an anti-ultraviolet agent, and a substance which provides strong viscosity, internal adhesion, and mechanical and shearing action to said second fluid.

33. A system according to claim 23, wherein said second fluid includes a heavy plasticizer, an anti-oxidant, an anti-ultraviolet agent, and a sandoly additive which gives said second fluid strong viscosity, internal adhesion, and mechanical and shearing action.

34. A system according to claim 23, wherein said second fluid includes a heavy plasticizer, an anti-oxidant, an anti-ultraviolet agent, and an isophthalic alkyd resin.

35. A system according to claim 23, wherein said second fluid includes a lime carbonate absorbing agent.

36. A system according to claim 23, wherein said second fluid includes a barium sulfate absorbing agent.

37. A system according to claim 23, wherein said fourth fluid includes arabic gum, water, and a bactericide agent.

38. A system according to claim 23, further comprising a sixth reservoir having a sixth fluid for maintaining the condition of microporous surfaces in said rollers and printing blankets including aliphatic diluent, isophthalic alkyd resin, lime carbonate, and monomer plasticizer.

39. A system according to claim 23, wherein at least one of said first through fifth fluids includes a thickening and flocculent agent, a bactericide agent, an agent for accelerating dilution, and a biodegradable washing powder.

40. A system according to claim 23, wherein at least one of said first through fifth fluids includes a thickening and flocculent agent, a bactericide agent, an agent for accelerating dilution, a biodegradable washing powder, and a tensioactive agent.

41. A system according to claim 23, wherein at least one of the said first through fifth fluids include anionic agents, which are absorbed by rubber-covered surfaces, and which electrostatically repel ink from attaching to said rubber-covered surfaces.

42. A system according to claim 23, wherein at least one of said first through fifth fluids including gelling agents for precipitating ink, and an electrostatic agent which is absorbed by rubber-covered surfaces and which electrostatically repels ink from attaching to said rubber-covered surfaces.

43. A system according to claim 23, wherein at least one of said first through fifth fluids includes ester polyglycolic of tall-oil, dodecylbenzene sodium sulphonate, and biodegradable washing powder.

44. An improved means for cleaning a printing press of the type having a plurality of printing press components including inking rollers, printing blankets, and printing plates, some of which have porous surfaces to which ink attaches comprising:

a plurality of fluids specially adapted for cleaning particular printing press components;

means for selectively dispensing said plurality of fluids to selected printing press components to clean the press;

a controller for coordinating the dispensation of fluids in a predetermined pattern;

said plurality of fluids including at least one fluid which includes an electrostatic agent which is absorbed by said porous surfaces and which electrostatically repels ink from attaching to said porous surfaces.

45. A system according to claim 44 wherein said at least one fluid further includes gelling agents from precipitating said ink from said porous surfaces.

46. A system according to claim 44, wherein said porous surfaces comprise rubber-covered surfaces, and wherein said fluid includes at least one electrostatic agent which is absorbed by said rubber-covered surfaces, and which electrostatically repel ink from attaching thereto.

47. A system according to claim 44, wherein said porous surfaces comprise rubber-covered surfaces, and wherein said fluid includes gelling agents for precipitating said ink, and at least one electrostatic agent which is absorbed by said rubber-covered surfaces and which electrostatically repel ink from attaching to said rubber-covered surfaces.

48. A system according to claim 44, wherein said at least one fluid includes at least one biodegradable cleaning agent.

49. A system according to claim 44, wherein said at least one fluid includes at least on bactericide agent.

50. An improved means for cleaning a printing press of the type having a plurality of printing press components including inking rollers, printing blankets, and printing plates, some of which have porous surfaces to which ink attaches comprising:

a plurality of fluids specially adapted for cleaning particular printing press components;

means for selectively dispensing said plurality of fluids to selected printing press components to clean the press;

said plurality of fluids including at least one fluid which includes an electrostatic agent which is absorbed by said porous surfaces and which electrostatically repels ink from attaching to said porous surfaces.

51. A system according to claim 50, wherein said at least one fluid further includes gelling agents for precipitating said ink from said porous surfaces.

52. A system according to claim 50, wherein said porous surfaces comprise rubber-covered surfaces, and wherein said fluid includes at least one electrostatic agent which is absorbed by said rubber-covered surfaces, and which electrostatically repel ink from attaching thereto.

53. A system according to claim 50, wherein said porous surfaces comprise rubber-covered surfaces, and wherein said fluid includes gelling agents for precipitating said ink, and at least one electrostatic agent which is absorbed by said rubber-covered surfaces and which electrostatically repel ink from attaching to said rubber-covered surfaces.

54. A system according to claim 50, wherein said at least one fluid includes at least one biodegradable cleaning agent.

55. A system according to claim 50, wherein said at least one fluid includes at least on bactericide agent.

* * * * *